US007270042B2

(12) United States Patent
Mori et al.

(10) Patent No.: US 7,270,042 B2
(45) Date of Patent: Sep. 18, 2007

(54) PAPER PUNCH APPARATUS

(75) Inventors: Makoto Mori, Tokyo (JP); Hiroshi Tadenuma, Tokyo (JP); Masayuki Kato, Tokyo (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 423 days.

(21) Appl. No.: 10/923,565

(22) Filed: Aug. 20, 2004

(65) Prior Publication Data

US 2005/0051016 A1 Mar. 10, 2005

(30) Foreign Application Priority Data

Sep. 4, 2003 (JP) ..... 2003-312707

(51) Int. Cl.
*B26D 1/06* (2006.01)

(52) U.S. Cl. ..... 83/684; 83/698.31; 83/698.91

(58) Field of Classification Search ..... 83/698.91, 83/698.31, 684, 685; 403/325, 326, 327
See application file for complete search history.

(56) References Cited

U.S. PATENT DOCUMENTS

| | | | | |
|---|---|---|---|---|
| 2,107,581 | A * | 2/1938 | Parsons et al. | 279/76 |
| 2,154,738 | A * | 4/1939 | Reuen | 279/76 |
| 3,089,376 | A * | 5/1963 | Whistler et al. | 83/619 |
| 3,289,519 | A * | 12/1966 | Piccone | 83/685 |
| 3,721,154 | A * | 3/1973 | Leibinger et al. | 83/698.71 |
| 3,779,122 | A * | 12/1973 | Sawvell | 83/698.91 |
| 4,316,399 | A * | 2/1982 | Wallis | 83/137 |
| 4,466,322 | A | 8/1984 | Mori | |
| 4,499,805 | A | 2/1985 | Mori | |
| 5,178,049 | A | 1/1993 | Tsai-Hsin | |
| 5,664,473 | A | 9/1997 | Huang | |
| 7,069,765 | B2 * | 7/2006 | Grove et al. | 72/481.1 |
| 2002/0007714 | A1 * | 1/2002 | Ohtsuka et al. | 83/698.31 |

FOREIGN PATENT DOCUMENTS

| | | |
|---|---|---|
| EP | 1226909 | 7/2002 |
| EP | 1 283 095 | 2/2003 |
| JP | 6-190794 | 7/1994 |
| JP | 6190794 | 7/1994 |
| JP | 9-109098 | 4/1997 |
| JP | 2000-233398 | 8/2000 |

* cited by examiner

*Primary Examiner*—Kenneth E. Peterson
(74) *Attorney, Agent, or Firm*—Everest Intellectual Property Law Group; Michael S. Leonard

(57) ABSTRACT

A paper punch apparatus comprising a flange-storing space for storing the flange portion in an elevating unit, an insertion/removal portion for insertably supporting a supporting axis of a bit reception plate in communication with the flange portion, and a bit-reception-plate engagement/disengagement portion for engagement/disengagement with respect to the flange portion of the bit reception plate in the flange-storing space, so that the bit reception plate can be parallelly and linearly inserted/detached with respect to the elevating unit, insertion/detachment can be steadily and securely performed at all times, whereby the apparatus is simple in structure, inexpensive, and excellent in, for example, paper punch functions, handling functions for a hole punch bit(s), bit reception plate(s), punched-paper-scrap discharge functions, and punch-position adjustment functions, and further the punch apparatus enables quality improvement, cost reduction, and the like to be implemented.

1 Claim, 17 Drawing Sheets

PAPER PUNCH APPARATUS

BACKGROUND OF THE INVENTION

1. Field of the Invention

The invention relates to a paper punch apparatus capable of securely and steadily punching a paper-binding hole(s) into one or more paper sheets between a bit reception plate and a tubular hole punch bit.

2. Description of the Related Art

Conventionally, various types of paper punch apparatuses that are capable of punching binding holes into, for example, one or more paper sheets by sandwiching the document paper sheets between a resin-discoidal bit reception plate and a hole punch bit formed in a metallic-tubular shape. As paper punch apparatuses of this type, high power paper punch apparatuses have been proposed.

For example, Japanese Patent Application Laid-Open No. 9-109098 (hereafter referred to as "Patent Reference 1") discloses a high power paper punch apparatus in which an elevating unit is supported on a base unit to be vertically movable via an operating handle, and a hole punch bit is fixed and supported immobilizably on the elevating unit. In a paper-stacking base fixedly mounted immobilizably on the base unit, an insertion concave portion is formed. A bit reception plate is inserted and supported rotatably in the insertion concave portion in a deflected state with respect to the vertical line of the hole punch bit. A bit tip portion of the hole punch bit has a positional relationship with the bit reception plate to perform approaching/detaching operation with respect to the bit reception plate.

Ratchet teeth are formed around a periphery of the bit reception plate. When the elevating unit descends with the operation of the operating handle, operation pawls engaging the ratchet teeth advance in the direction opposite the rotational direction of the ratchet teeth via an interlocking mechanism connectively operating with the operating handle. In contrast, when the elevating unit ascends with the operation of the operating handle, the operation pawls engage the ratchet teeth via the interlocking mechanism whereby to cause the bit reception plate to rotate by one pitch.

In the paper punch apparatus, a contact position between the bit reception plate and the hole punch bit can be changed each time the operating handle is manipulated. As such, the construction prevents such an event that the hole punch bit constantly abuts a same portion whereby causing a ringular extracting groove on the bit reception plate. The consequence enables overcoming such shortcomings that when punching paper holes into a plurality of paper sheets, the lowest paper sheet engages the ringular extracting groove caused by a bit tip portion of the hole punch bit whereby making it impossible to take out the lowest paper sheet.

By way of another example paper punch apparatus, a paper punch apparatus disclosed in Japanese Patent Application Laid-Open No. 2000-233398 (hereafter referred to as "Patent Reference 2") will be discussed. The apparatus is constructed such that an elevating unit is supported on a base to be vertically movable by using an operating handle, and a hole punch bit is insertable and detachable with respect to the elevating unit. In the paper punch apparatus disclosed in the publication, an insertion/detachment opening is formed in the horizontal direction perpendicular to the elevational direction in a lower portion of the elevating unit, and a hole-punch-bit support unit for fittably supporting the hole punch bit is inserted and supported in the insertion/detachment opening to be insertable and detachable.

The hole-punch-bit support unit has an engagement/disengagement member resiliently vertically moving toward an inner upper surface of the insertion/detachment opening. The engagement/disengagement member has an engagement/disengagement detent for performing engagement/disengagement with respect to an engagement/disengagement concave portion formed on an inner upper surface of the insertion/detachment opening, and manipulation piece extending on a side opposite the engagement/disengagement detent. When the engagement/disengagement member is engageably inserted into the insertion/detachment opening in resistance with spring forces, the engagement/disengagement member resiliently returns upwardly at an engageable insertion limit position of the hole-punch-bit support unit. Then, push-up force of the engagement/disengagement detent is received in the engagement/disengagement concave portion, whereby the engagement/disengagement concave portion and the engagement/disengagement detent are engaged with each other.

By way of another example paper punch apparatus, a paper punch apparatus disclosed in the Japanese Patent Application Laid-Open No. 6-190794 (hereafter referred to as "Patent Reference 3") will be discussed. The paper punch apparatus is capable of preventing fall of paper perforation scraps being discharged from the inside of an upper-side cylinder of a tubular hole punch bit approachable and detachable with respect to a bit reception plate disposed on a paper stacking base. The paper punch apparatus disclosed in the publication is constructed such that an elevating unit is supported on a base unit to be vertically movable with an operating handle, a scrap collection receptacle is attachably and removably tightened and fixed to the elevating unit, and a proximal end portion of the hole punch bit is attachably and removably tightened and fixed to a bottom portion of the scrap collection receptacle. A proximal-end-side opening of the hole punch bit communicates with the inside of the scrap collection receptacle.

In the paper punch apparatus disclosed in Patent Reference 1, the bit reception plate formed into a discoidal shape disposed away downwardly from the operating handle is inserted and supported in an automatically rotatable fashion inside the insertion concave portion of the paper-stacking base. In addition, the hole punch bit fixedly supported in immobile manner on the elevating unit is disposed in a relatively movable fashion with respect to the bit reception plate. As such, structurally, an intricate interlocking mechanism should be provided that causes connective operation of the operating handle and the bit reception plate to automatically rotate at a predetermined angle in association with rotational movement.

For the provision of the interlocking mechanism causing the connective operation of the operating handle and bit reception plate, high level relative-position setting, positioning, and the like should be adjusted for the operating handle, bit reception plate, interlocking mechanism, and the like. When required accuracies of setting dimensions, assembly adjustment, and the like cannot be obtained, it is impossible to bring an actuating force to act on the bit reception plate away from the operating handle. As a result, it becomes difficult to operate the operating handle, the bit reception plate, or the interlocking mechanism in a synchronous, smooth, and steady manner. In addition, the intricate interlocking mechanism for causing the connective operation of the operating handle and bit reception plate is required to be provided. This arises a problem in that the number of components is increased, leading to the cause of associated problems of significantly increasing, for example, assembly costs and manufacturing costs.

The conventional paper punch apparatus disclosed in Patent Reference 2 is now viewed. As described above, in this apparatus, the engagement/disengagement detent of the engagement/disengagement member resiliently vertically moving toward the inner upper surface of the insertion/detachment opening is engaged with the engagement/disengagement concave portion formed on the inner upper surface of the insertion/detachment opening. As such, an engagement surface of the engagement/disengagement detent and an engagement surface of the engagement/disengagement concave portion are therefore positioned perpendicular to the insertion direction of the hole-punch-bit support unit. As such is the structure, when releasing the engagement state between the elevating unit and the hole-punch-bit support unit, while the engagement surface is being moved down by a distance necessary to climb over the top end of the engagement/disengagement detect in resistance with the elastic force, an excessively high force necessary to cause the engagement surface of the engagement/disengagement concave portion to directly act on the manipulation piece, which extends to the opposite side of the engagement/disengagement detent.

At this event, of course the force acting on the manipulation piece to release the engagement with the engagement surface of the engagement/disengagement concave portion should be maintained. Concurrently, however, the hole-punch-bit support unit should be withdrawn along a withdrawal direction perpendicular to depression force of the manipulation piece. That is, when withdrawing the hole-punch-bit support unit, the unit should perform stepwise operations bidirectionally along the depression direction of the manipulation piece and the withdrawal direction thereof perpendicular to the withdrawal direction. This significantly impairs the mountability and operability of the hole-punch-bit support unit.

Further, the withdrawal of the hole-punch-bit support unit with respect to the elevating unit requires considerably high force. Thereby, not only the mountability and operability of the hole-punch-bit support unit are deteriorated, but also drawbacks such as entanglements, damage, and deflection are promoted. Regarding the discoidal bit reception plate, it is ordinarily inserted and supported in the insertion concave portion of the paper-stacking base, as in the conventional techniques disclosed in Patent Reference 1. As such, the bit reception plate cannot therefore easily be removed to the outside from the inside of the insertion concave portion with hands and fingers in such an event of replacing the bit reception plate. Here arises another problem of making the removal operation thereof to be complex, making it impossible to quickly perform punch operation.

In general, conventional paper punch apparatuses form punch holes in such a manner that in association with the pivotal operation of the operating handle, a top-end bit tip portion(s) of the tubular hole punch bit(s) is pushed at one time to a number of paper sheets (paper set) placed on the paper stacking base. As described above, in the conventional paper punch apparatus disclosed in Patent Reference 3, the proximal end portion of the hole punch bit is attachably and removably tightened and fixed to the bottom portion of the scrap collection receptacle fixed to the elevating unit. As such is the structure, sufficient high post-mounting strengths of these components should be secured, thereby significantly increasing the number of components. This arises the problems of significantly increasing costs such as assembly costs, manufacturing costs, and component costs in association with the increase in the number of components.

In addition, the proximal-end-side opening of the hole punch bit communicates with the inside of the scrap collection receptacle through the bottom of the scrap collection receptacle. As such, paper perforation scraps discharged from the inside of the upper-side cylinder of the hole punch bit can be directly stored into the scrap collection receptacle. However, as a large amount of paper perforation scraps are stored in the scrap collection receptacle, paper perforation scraps are nonuniformly piled in peripheral portions of the tubular hole punch bit.

For the above reason, paper perforation scraps block an upper-end-side opening before filling the inside of the scrap collection receptacle, whereby causing punched paper scraps to jam. Consequently, not only does such the troublesome event disable effectively using the inside of the scrap collection receptacle, but also it can easily lead to deflection, damage, and the like of the hole punch bit due to jammed paper perforation scraps, whereby leading to the cause of significantly impairing the functionality of the hole punch bit.

Further, as in the prior art disclosed in Patent Reference 1, a paper abutment member is fixed and supported in an erect state perpendicular to extending end portions of a pair of side gauge racks disposed extendible in both-side end portions of the base unit. In this construction, hole-punching operation can be performed by positioning the paper center. However, punch holes cannot be formed in such a manner that, regardless of the paper size, same punch positions are chosen in accordance with the paper upper or lower ends being used as a reference. As such, it is difficult to bind papers into files by arranging the papers in desired arrangement patterns.

Thus, the individual prior arts disclosed in Patent References 1 to 3 have various problems. They are, for example, problems of impairing the mountabilities and operabilities of the components such as the hole punch bit and bit reception plate; problems of causing the functionality of the tubular hole punch bit to be impaired due to paper perforation scraps accumulated in the scrap collection receptacle; and problems of disabling accurate setting of same punch positions in the upper or lower ends of paper sheets of different sizes.

Accordingly, what is strongly demanded is that while the structure is simple, improvements can be implemented for punching function, handling function of the hole punch bit and bit reception plate, the punched-paper-scrap discharge function and the punch-position adjustment function, for example. If the demand is satisfied, quality improvement and cost reduction for the paper punch apparatus can be implemented.

SUMMARY OF THE INVENTION

The invention is made in view of the problems described above. An object of the invention is, therefore, to provide a paper punch apparatus that is simple in structure, inexpensive, and offers various functions and improvements. More specifically, the punch apparatus offers various excellent functions, such as handling functions for a hole punch bit(s), bit reception plate(s), and the like, punched-paper-scrap discharge functions, punch-position adjustment functions, and that while steadily securing these functions, enables implementing improvements such as quality improvement and cost reduction.

According to a first aspect of the invention, there is provided a paper punch apparatus for forming a binding hole(s) into one or more paper sheets between a bit reception plate and a tubular hole punch bit, being characterized in that the bit reception plate comprises a supporting axis, a flange portion at one end thereof, and a discoidal main body at another end thereof, and a main body of the punch apparatus comprises an insertion/removal portion for insertably supporting the supporting axis, a flange-storing space for storing the flange portion, and a bit-reception-plate engagement/disengagement portion for engagement/disengagement with respect to the flange portion of the bit reception plate in the flange-storing space.

In the first aspect of the invention, the punch apparatus is further characterized in that an engagement/disengagement concave portion is formed in the flange portion of the bit reception plate, and the bit-reception-plate engagement/disengagement portion comprises an engagement/disengagement protrusion for engagement/disengagement with respect to the engagement/disengagement concave portion, an engagement/disengagement member to be resiliently urged toward the engagement/disengagement concave portion, and an engagement/disengagement member operation portion for vertically moving the engagement/disengagement member.

In this case, the punch apparatus is further characterized in that the engagement/disengagement member comprises a large-diameter circularly cylindrical portion and a small-diameter rod portion that are colinearly disposed via a stepped face, and the engagement/disengagement member operation portion resiliently supports an oscillatory movement piece, which oscillatorily moves with a central position as an oscillatory-movement supporting point, and a manipulation knob wherein one end of the oscillatory movement piece is fitted on the stepped face of the engagement/disengagement member and resiliently supported and another end thereof is abutting the manipulation knob.

According to a second aspect of the invention, there is provided a paper punch apparatus for forming a binding hole(s) into one or more paper sheets between a bit reception plate and a tubular hole punch bit being characterized in that the main body of the paper punch apparatus comprises an insertion/retraction guide portion of a hole-punch-bit support unit, and an engagement hole portion provided on a portion of the insertion/retraction guide portion for engagement/disengagement with respect to a portion of the hole-punch-bit support unit; the hole-punch-bit support unit comprises a hole-punch-bit support portion in one end portion and an insertion/detachment manipulation portion and an engagement/disengagement portion at another end portion; the hole-punch-bit support portion comprises a proximal end opening of the hole punch bit that communicates with an opening of the main body of the punch apparatus, and insertion-supports a proximal end portion of the hole punch bit in the proximal end opening; the insertion/detachment manipulation portion causes engagement/disengagement of the hole-punch-bit support portion in a predetermined position of the main body of the punch apparatus; and the engagement/disengagement portion interconnects between the hole-punch-bit support portion and the insertion/detachment manipulation portion for engagement/disengagement with respect to the engagement hole portion of the main body of the punch apparatus.

In this aspect, the punch apparatus is characterized in that the insertion/detachment manipulation portion comprises a substantially L-shaped oscillatory movement member that oscillatorily moves with a supporting point in a center, a manipulation piece at one end of the oscillatory movement member, and at another end an engagement/disengagement member that is resiliently urged along one direction within an oscillatory movement plane of the manipulation piece; and the engagement/disengagement member comprises an engagement/disengagement portion for resilient engagement/disengagement with respect to an engagement hole portion of the main body of the punch apparatus.

In the above case, the punch apparatus is characterized by further comprising at an oscillatory movement end of the engagement/disengagement member, a resilient contact piece for supporting the proximal end portion of the hole punch bit in a resilient contact fashion.

Further, in the second aspect, the punch apparatus is characterized in that the insertion/detachment manipulation portion comprises an oscillatory movement member and a manipulation member; the oscillatory movement member oscillatorily moves with a central portion as a supporting point and comprises a manipulation piece in a portion on a side opposite the hole punch bit with respect to the supporting point in the center; the manipulation member is disposed perpendicularly to the manipulation piece so as to be resiliently movable in a horizontal direction, and moves the manipulation piece in one direction; the engagement/disengagement portion comprises an engagement/disengagement member that is disposed at an oscillatory movement end of the oscillatory movement member on a side of the hole punch bit and that resiliently urges the oscillatory movement end of the oscillatory movement member in one direction; and the engagement/disengagement member comprises in a portion thereof an engagement/disengagement portion for resilient engagement/disengagement with respect to the engagement hole portion of the main body of the punch apparatus.

According to a third aspect of the invention, there is provided a paper punch apparatus for forming a binding hole(s) into one or more paper sheets between a bit reception plate and a tubular hole punch bit, being characterized by comprising a scrap collection receptacle attachably and removably disposed to collect punched paper scraps discharged from an inside of a cylinder of the hole punch bit, wherein the scrap collection receptacle comprises a punched-paper-scrap inlet and an open/close lid unit at an upper surface, wherein an inside of the scrap collection receptacle expands to the open/close lid unit, and a corner portion is formed into a concavely curved face.

According to a fourth aspect of the invention, there is provided a paper punch apparatus for forming a binding hole(s) into one or more paper sheets between a bit reception plate and a tubular hole punch bit, being characterized by comprising a pair of side gauge racks disposed extendibly in both-side end portions of a paper-stacking base; and a pair of left and right paper abutment members that are disposed at extending end portions of the individual side gauge racks and that are each supported to be rotationally movable with a horizontal supporting axis, which is positioned perpendicularly to each of the side gauge racks, in a center.

In the fourth aspect, the punch apparatus is characterized in that each of the paper abutment member comprises a stopper member that resiliently abuts an edge face of the side gauge rack whereby to position the paper abutment member at two positions: a first position perpendicular to the side gauge rack and a second position present on an axis line along a longitudinal direction thereof.

In the above case, the punch apparatus is further characterized in that a corner portion on an end-portion lower end portion side of the side gauge rack comprises a first rotation guide face of the paper abutment member; and an upper-end corner portion of the paper abutment member comprises a second rotation guide face with respect to the side gauge rack on a side opposite the first rotation guide face.

According to a fifth aspect of the invention, there is provided a paper punch apparatus for forming a binding hole(s) into one or more paper sheets between a bit reception plate and a tubular hole punch bit, being characterized in that the bit reception plate is disposed rotationally with a central axis thereof in a center in a main body of the punch apparatus; the tubular hole punch bit is disposed opposite an eccentric position of the bit reception plate; and the punch apparatus comprises an automatic rotation mechanism between the bit reception plate and the main body of the punch apparatus, wherein the automatic rotation mechanism performs a connective operation with a relative approaching/detaching operation between the tubular hole punch bit and the bit reception plate whereby to rotate the bit reception plate by a predetermined angle.

In the fifth aspect of the invention, the punch apparatus is characterized in that the automatic rotation mechanism of the bit reception plate comprises a gear for rotating the bit reception plate; and an engagement/disengagement member that performs resilient engagement/disengagement with respect to the gear in connective operation with the approaching/detaching operation between the tubular hole punch bit and the bit reception plate whereby to rotate the bit reception plate by a predetermined angle in one direction via the gear.

In the above case, the punch apparatus is characterized by further comprising a detent member that engages the gear independently of the engagement/disengagement member to prevent backward rotation of the bit reception plate.

In addition, in the above case, the punch apparatus is characterized in that the gear is formed on a periphery of the supporting axis of the bit reception plate or a periphery of the bit reception plate.

In addition, in the above case, the punch apparatus is characterized in that the engagement/disengagement member comprises a resilient-engagement detent.

In the fifth aspect of the invention, the punch apparatus is characterized in that the automatic rotation mechanism of the bit reception plate comprises a pinion for rotating the bit reception plate; a linear rack that performs resilient engagement/disengagement with respect to the pinion in connective operation with the approaching/detaching operation between the tubular hole punch bit and the bit reception plate whereby to engage the pinion; and an engagement/disengagement mechanism for causing the pinion and the rack to perform engagement/disengagement with respect to each other.

In the above case, the punch apparatus is characterized in that the engagement/disengagement mechanism comprises a second engagement/disengagement member that is disposed parallel with the rack and that independently moves in a same direction as the rack; an interlocking member that is disposed perpendicularly to a movement direction of the second engagement/disengagement member and that moves the rack to the pinion in connective operation with the second engagement/disengagement member; and a return spring portion that is disposed via the rack being sandwiched on a side opposite the interlocking member and that urges the rack in a detachment direction from the pinion at the time of cancellation of pressure force of the second engagement/disengagement member acting on the rack.

In the above case, the punch apparatus is characterized in that the return spring portion comprises an engagement concave portion formed in the rack; and an engagement protrusion that resiliently engages the engagement concave portion at the time of engagement between the rack and the pinion.

Advantages and/or effects of the invention will be described hereunder. In the first aspect, there are formed the flange-storing space for storing the flange portion of the bit reception plate into the main body of the punch apparatus; the insertion/removal portion that communicates with the flange portion and that insertably supports the supporting axis of the bit reception plate; and the bit-reception-plate engagement/disengagement portion for engagement/disengagement with respect to the flange portion of the bit reception plate in the flange-storing space. Accordingly, the bit reception plate can be inserted and detached linearly in parallel with respect to the main body of the punch apparatus, thereby enabling the bit reception plate to be inserted and detached steadily and securely at all times.

The "paper" used in the description of the paper punch apparatus according to the invention is not limited to a general paper, but it includes, for example, synthetic-resin films and thin planar sheets. That is, the present specification is written based on the concept of the "paper" including any material that can be perforated by the paper punch apparatus of the invention.

The description regarding the punch apparatus defines a typical structure of the bit-reception-plate engagement/disengagement portion adapted to the apparatus. The description regarding the punch apparatus defines practical constructions of the engagement/disengagement member and the engagement/disengagement member operation portion and related mechanisms thereof.

According to the constructions, the engagement/disengagement member is supported in the main body of the punch apparatus oscillatorily movably in the direction perpendicular to the insertion/retraction direction of the bit reception plate, whereby the bit reception plate is resiliently engaged and disengaged. In this case, when the manipulation knob is manipulated in the direction perpendicular to the insertion/retraction direction of the bit reception plate, the engagement between an engagement/disengagement concave portion formed in the flange portion of the bit reception plate and an engagement/disengagement protrusion of the engagement/disengagement member can be released. While the structure is thus simple, the bit reception plate can be operated smoothly, steadily, and securely at all times with respect to the main body of the paper punch apparatus, handling thereof is very easy, and the bit reception plate can easily be mounted.

According to the second aspect, the engagement/disengagement member of the engagement/disengagement portion is supported in the hole-punch-bit support unit insertion-supporting the proximal end portion of the hole punch bit to be oscillatorily movable in the direction perpendicular to the insertion/retraction direction of the main body of the paper punch apparatus. This engagement/disengagement member is brought into resilient engagement or disengagement with respect to the engagement portion of the main body of the paper punch apparatus. Accordingly, when the manipulation piece of the insertion/detachment manipulation portion is manipulated in the same direction as the insertion/retraction direction of the hole-punch-bit support unit, the engagement between the engagement portion and the engagement/disengagement portion of the engagement/disengagement member can be released, and hole punch operation can be quickly performed.

Thus, the structure of the hole-punch-bit support unit can be compactly formed, and hence miniaturization, compaction, and the like of the overall apparatus can be securely implemented. In addition, while the structure is thus simple, the hole-punch-bit support unit can be operated smoothly, steadily, and securely at all times with respect to the main body of the paper punch apparatus, and handling thereof is very easy.

As in the case of the second aspect, the punch apparatus preferably comprises at the oscillatory movement end of the engagement/disengagement member, the resilient contact piece for supporting the proximal end portion of the hole punch bit in a resilient contact fashion. In the presence of the resilient contact piece, the number of assembly components can be reduced. In addition, the hole-punch-bit support unit can be manufactured at reduced costs, and miniaturization of the hole-punch-bit support unit can be accomplished.

According to the invention as in the case of this aspect, the manipulation member is disposed to resiliently engage with or disengage from the engagement/disengagement member via the oscillatory movement member supported to be oscillatorily movable in the direction perpendicular to the insertion/retraction direction of the hole-punch-bit support unit. Accordingly, when the manipulation member is pushed in the horizontal direction perpendicular to the withdrawal direction of the hole-punch-bit support unit, the engagement between a base unit and the engagement/disengagement member can be released, and replacement operation therefor can be quickly performed.

According to the third aspect, the scrap collection receptacle is formed in the manner that the inside portion thereof gradually expands upward to the side of the open/close lid unit from the side of the punched-paper-scrap inlet, and the corner portion is formed into the concavely curved face. In addition, the inside portion of the scrap collection receptacle is completely covered so as not to be exposed to the outside except for the inlet.

This construction therefore enables to prevent such cases in which at the time of carrying the apparatus and at the time of withdrawing the scrap collection receptacle, punched paper scraps stored in the scrap collection receptacle scatter, clutter up a work table and peripheral portions of the work table, and adhere to peripheral mechanisms whereby deteriorating operabilities thereof. Additionally, punched paper scraps collected from the inside of the hole punch bit into the scrap collection receptacle can be smoothly, easily, and securely moved along the curved face from the side of the inlet toward the side of the open/close lid unit.

Consequently, when the scrap collection receptacle has become full, agglomerated punched paper scraps push up the open/close lid unit. Thereby, punched paper scraps can be prevented from being jammed in the hole punch bit, and hence the hole punch bit can be prevented from, for example, being deformed and damaged.

According to the fourth aspect, the paper abutment member is capable of positioning the center of to-be-punched paper, and the paper abutment member of each of the side gauge racks can be supported at two independent positions: an erection position perpendicular to the side gauge rack and a lay-down position along the axis line in the longitudinal direction of the side gauge rack. Accordingly, regardless of the size of to-be-punched paper, holes can be formed by arbitrarily choosing, for example, the same punch positions and number of punch holes with the upper edge or lower edge of paper being used as a reference. Consequently, papers can be arranged and bound in the form of a file in a desired arrangement pattern.

As in the case of the fourth aspect, the paper abutment member preferably comprises a stopper member that resiliently abuts the edge face of the side gauge rack whereby to position the paper abutment member at two positions: the first position perpendicular to the side gauge rack and the second position present on the axis line along the longitudinal direction thereof.

As in the case of the forth aspect, the corner portion on the end-portion lower end portion side of the side gauge rack preferably comprises the first rotation guide face of the paper abutment member; and the upper-end corner portion of the paper abutment member preferably comprises the second rotation guide face of the side gauge rack on the side opposite the first rotation guide face.

The first rotation guide face of the side gauge rack and the second rotation guide face of the paper abutment member individually have an arcuate-face shaped cross section with the a horizontal axis perpendicular to the side gauge rack in the center whereby to prevent interference between the side gauge rack and the paper abutment member during rotational movements. When the paper abutment member is rotationally operated from a laid-down state to an erection direction perpendicular to the side gauge rack, the paper abutment member is erected along the each rotation guide face in a state it is pushed on an edge face of the side gauge rack in resistance with spring force of the stopper member.

When the stopper member passes over an upper-end corner portion of the side gauge rack, the spring force of the stopper member is further strengthened to bring the paper abutment member to engage with an end-portion upper face of the side gauge rack. In this engagement state, even when trying to further rotate the paper abutment member, the stopper member abuts the end-portion upper face of the side gauge rack whereby to restrict the further rotation of the paper abutment member.

According to the prior arts disclosed in Patent Reference 1, the intricate interlocking mechanism for performing connective operation of the operating handle and the bit reception plate to rotate the bit reception plate by a predetermined angle in association with the rotational operation, as described above. In comparison, according to the fifth aspect, the apparatus has the mechanism, between the bit reception plate and the main body of the apparatus, that rotates the bit reception plate by a predetermined angle in connective operation with approaching/detaching operation of the hole punch bit and the bit reception plate. Thereby, the intricate interlocking mechanism as disclosed in the prior art can be avoided, and the simply structured automatic rotation mechanism can be intensively disposed in the same plane as the bit reception plate.

With the automatic rotation mechanism being employed, while the structure is simple, the paper punch position, punch hole size, pattern, and the like can be accurately and stably ensured at all times. Thereby, the quality of, for example, the bit reception plate and hole punch bit can be enhanced, and safety, reliability, and the like thereof in use time can be significantly improved. In addition, since the intricate interlocking mechanism can be avoided, reduction of costs such as assembly costs, manufacturing costs, and material costs can be implemented in conjunction with the reduction of components of the automatic rotation mechanism. In addition, miniaturization, compaction, weight reduction, and the like of the overall apparatus can be securely implemented. Further, the handling thereof can be made easy.

By way of a preferable mode of an automatic rotation mechanism to be adapted to the invention, as in the fifth aspect, the automatic rotation mechanism for the bit reception plate preferably comprises the gear for rotating the bit reception plate. In addition, the mechanism preferably comprises the engagement/disengagement member that performs resilient engagement/disengagement with respect to the gear in connective operation with the approaching/detaching operation between the hole punch bit and the bit reception plate whereby to rotate the bit reception plate by a predetermined angle in one direction via the gear.

As in the fifth aspect, it is preferable that the automatic rotation mechanism further comprises a detent member that engages the gear independently of the engagement/disengagement member to prevent backward rotation of the bit reception plate. For the detent member, a resilient engagement detent may be used, for example.

In addition, as in the fifth aspect, the gear may be formed on a periphery of the supporting axis of the bit reception plate or a periphery of the bit reception plate. For the engagement/disengagement member, a general operation pawl for performing resilient engagement/cancellation with respect to ratchet teeth serving as a gear may be used. However, a resilient engagement detent may be used for the engagement/disengagement member.

In the automatic rotation mechanism for the bit reception plate, a tip engagement face of a resilient engagement detent of the engagement/disengagement member resiliently engages the gear. The engagement/disengagement member is operated to advance in the direction opposite the rotational direction of the gear of the bit reception plate in the event of approach of the hole punch bit and the bit reception plate. In this case, the tip engagement face of the resilient engagement detent of the detent member on one side is engaged with the gear to prevent backward rotation of the bit reception plate.

An event is now assumed that the hole punch bit and the bit reception plate have approached. In this case, since the resilient engagement detent of the detent member is immobilizably engaged with the gear, the resilient engagement detent of the engagement/disengagement member is resiliently deflected in an expanding direction for releasing the engagement thereof with the gear, and concurrently the gear passes over the tip engagement face of the resilient engagement detent of the engagement/disengagement member. The deflection caused in resistance with the resilience of the resilient engagement detent resiliently returns to an intertooth portion whereby to establish the engagement between the gear and the resilient engagement detent. In this engagement state, further rotation is stopped, and the rotation of the bit reception plate is automatically stopped.

Conversely, when the hole punch bit and the bit reception plate leave, the engagement/disengagement member is operated to advance along the rotational direction of the gear. At this event, the resilient engagement detent of the detent member leaves from the gear whereby to release the engagement between the detent member and the gear. At the release time, the resilient engagement detent of the engagement/disengagement member pushes gear whereby to cause the gear to automatically rotate by one pitch at a predetermined rotation angle in one direction.

Another preferable mode of an automatic rotation mechanism for the bit reception plate is as follows. That is, the automatic rotation mechanism of the bit reception plate preferably comprises the pinion for rotating the bit reception plate; the linear rack that performs resilient engagement/disengagement with respect to the rack in connective operation with the approaching/detaching operation between the hole punch bit and the bit reception plate whereby to engage the pinion; and the engagement/disengagement mechanism for causing the pinion and the rack to perform engagement/disengagement with respect to each other.

As in the fifth aspect, the engagement/disengagement mechanism preferably comprises the second engagement/disengagement member, the interlocking member, and the return spring portion. Further, the return spring portion preferably comprises the engagement concave portion formed in the rack; and the engagement/disengagement protrusion that resiliently engages the engagement concave portion at the time of engagement between the engagement concave portion and the rack.

Thus, for the engagement/disengagement between the bit reception plate and the engagement/disengagement member, the engagement/disengagement mechanism is used in which the gear of the bit reception plate is formed of the pinion, the engagement/disengagement member is formed of the rack in lieu of the resilient engagement detent, and the engagement/disengagement is performed in association with the depression operation performed by the second engagement/disengagement member. With the bit-reception-plate automatic rotation mechanism having the construction described above, while the engagement between the rack and the pinion is released in a first stage, the bit reception plate is maintained in a static state unless otherwise the pressure force of the second engagement/disengagement member is canceled.

In this state being maintained, in a second stage, the pressure force of the second engagement/disengagement member is canceled, the engagement/disengagement protrusion of the return spring portion is urged in the direction of detachment from the engagement concave portion of the rack, and the pressure force of the interlocking member is canceled. Then, the engagement between the rack and the pinion is released, and the second engagement/disengagement member returns to an initial position. While this state is being maintained, a locked state of the bit reception plate is maintained.

In the event of engagement between the rack and the pinion, in the first stage, the rack and the pinion are engaged with each other via the interlocking member when the second engagement/disengagement member is pressed. In the second state, while this state is being maintained, when the rack is pressed, the rack and the pinion are engaged with each other, whereby the bit reception plate is rotated by one pitch at a predetermined rotation angle in one direction. Concurrently, the engagement/disengagement protrusion of the return spring portion is resiliently engaged with the engagement concave portion of the rack whereby to maintain the locked state of the bit reception plate.

The punch apparatus has the construction that rotates the bit reception plate by a predetermined angle in connective operation with approaching/detaching operation of the hole punch bit and the bit reception plate. The simply structured automatic rotation mechanism can be intensively disposed in the same plane as the bit reception plate. Components such as the rack, the pinion, and the second engagement/disengagement member may each be of a structure similar to a simple rectangular plate piece, and need not be formed into an intricate structure. Accordingly, miniaturization, compaction, weight reduction, thickness reduction, and the like of the overall apparatus can be securely implemented.

DESCRIPTION OF THE PREFERRED EMBODIMENTS

Preferred embodiments according to the invention will be described below with reference to the accompanying drawings.

Figure 1:
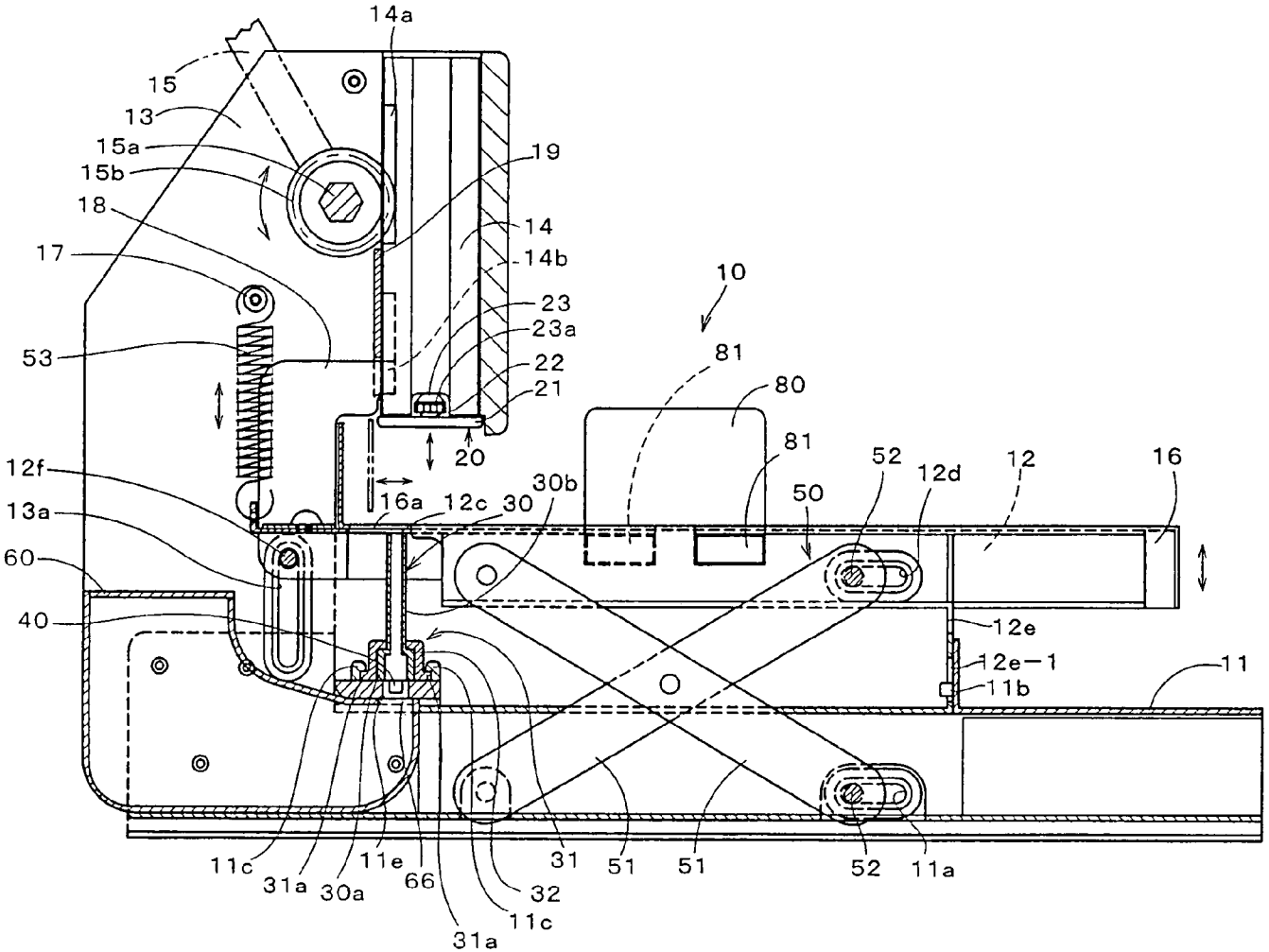
FIG. 1 is a schematic overall side view showing a vertical cutaway of major portions of a paper punch apparatus representing a typical embodiment according to the invention.
Figure 2:
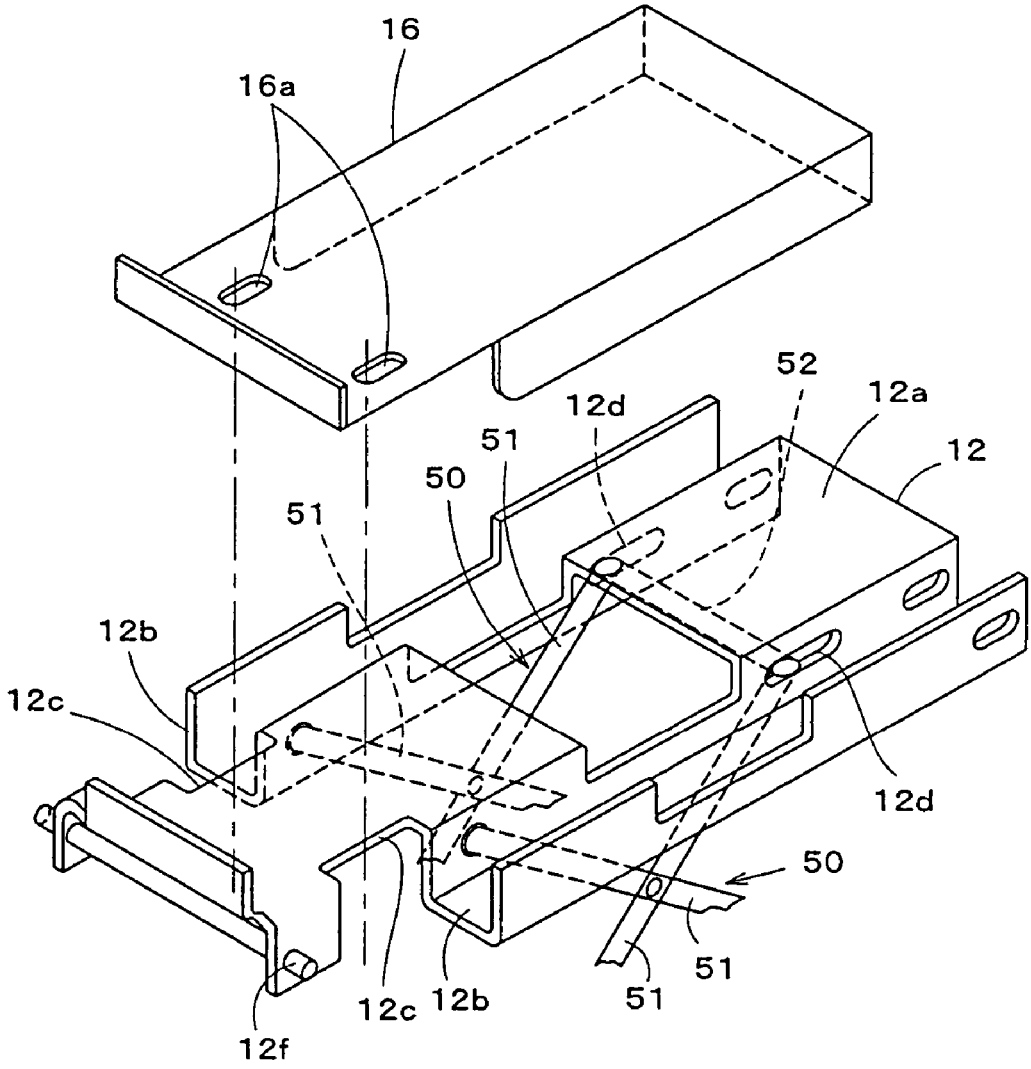
FIG. 2 is a perspective view showing a state where components partly constituting the punch apparatus are segregated.
Figure 3:
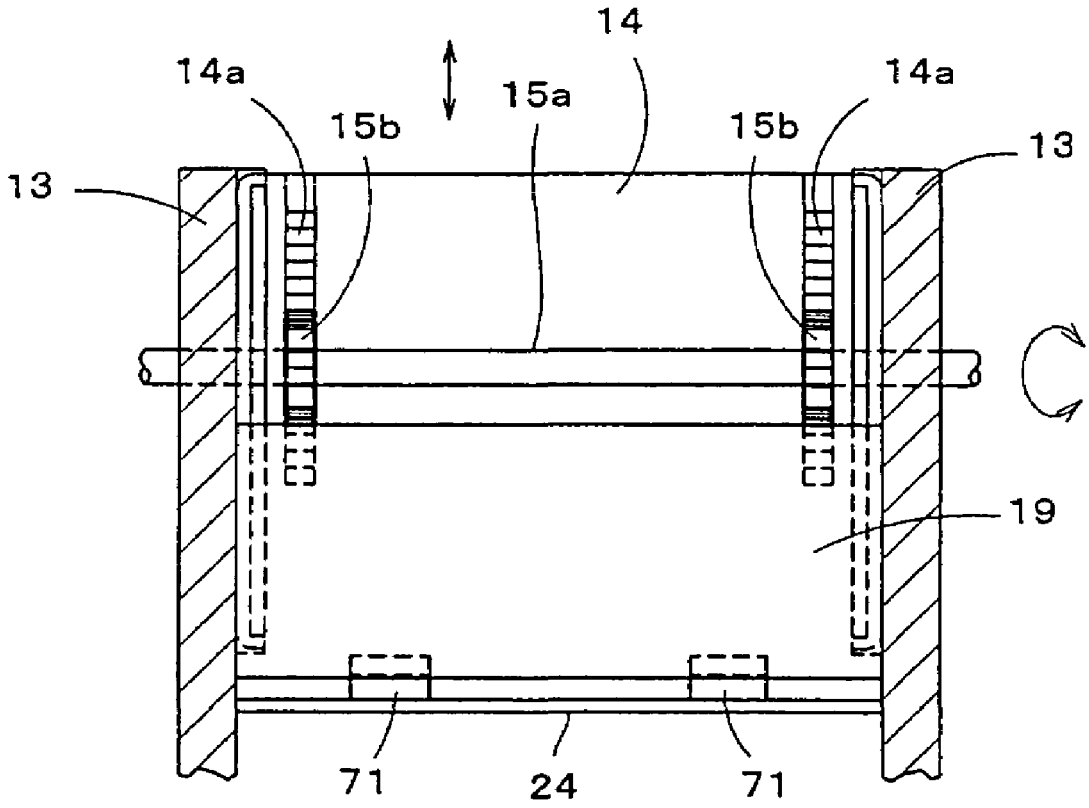
FIG. 3 is a schematic rear view of the punch apparatus.

FIG. 1 is a schematic overall side view showing a vertical cutaway of major portions of a paper punch apparatus representing a typical embodiment according to the invention. FIG. 2 is a perspective view showing a state where components partly constituting the punch apparatus are segregated. FIG. 3 is a rear view of the punch apparatus.

The present embodiment is described with reference to an example of the paper punch apparatus. The apparatus has proximal end portions of hole punch bits immobilizably disposed on a base unit; bit reception plates disposed to be detachable and contactable with respect to upper-end bit tip portions of the hole punch bits via an elevating unit disposed on the base unit to be elevationally movable; and parallel link mechanisms with which a paper stacking base vertically moves while constantly maintaining a parallel state with respect to the base unit.

However, the invention is not limited to the example apparatus. For example, the invention is adaptable to a paper punch apparatus that does not use the parallel link mechanisms and that has the paper stacking base fixed and supported on the base unit, hole punch bits fixed and supported on one of the elevating unit and the base unit, and bit reception plate fixed and supported on the other one of the elevating unit and the base unit.

In addition, the example paper punch apparatus to be described of a double-hole forming type that has a pair of left and right hole punch bits and a pair of left and right bit reception plates. However, the invention is not limited thereto, and the invention is usable with a paper punch apparatus in which one or more bit reception plates are each provided to be relatively movable with respect to an opposing upper-end bit tip portion of a hole punch bit.

Specifically, FIG. 1 shows a paper punch apparatus 10 that forms paper-binding holes into one or more paper sheets between discoidal bit reception plates 20 and tubular hole punch bits 30. The punch apparatus 10 has a base unit 11 having a form of a rectangular parallelepiped longitudinally extending in a backward-forward direction; a paper-stacking base 12 mounted in an upper portion of the base unit 11 to be vertically movable; a pair of supporting walls 13, 13 erected in rear end portions (left side in FIG. 1) of the base unit 11; an elevating unit 14 guided and supported along opposite faces of the side walls to be vertically movable; and an operating handle 15 substantially in a reverse U shape for vertically moving the elevating unit 14.

The bit reception plates 20 (21-23) are disposed by being inserted in insertion openings 24*a* individually formed in both left and right wall portions in lower end portions of the elevating unit 14, more specifically in both left and right wall portions disposed in lower end portions in the direction perpendicular to the paper surface of FIG. 1. A lower end of the hole punch bit 30 is fixed to the base unit 11, and the upper-end bit tip portion thereof is disposed to extend through the paper-stacking base 12.

Referring to FIG. 2, the paper-stacking base 12 has a pair of sidewall portions 12*b*, 12*b* on both left and right sides each having a substantially U form bent at multi-steps in the same direction as a part of both side portions extending along the longitudinal direction of an upper wall portion 12*a* in a planner state. The paper-stacking base 12 is formed of a metal plate of which a vertical cross section has a substantially Ω form. On the upper wall portion 12*a*, a metal cover 16 having a substantially transverse C cross sectional shape is disposed to be movable forwardly and rearwardly in the longitudinal direction. A portion between opposite faces of the individual sidewall portions 12*b* of the paper-stacking base 12 forms a guide rail portion that inductively guides left and right sidewall portions of the metal cover 16.

In both side end faces on a rear side along the longitudinal direction of the paper-stacking base 12, there are formed recessed cutout portions 12*c*, 12*c* inwardly formed (each with a recessed step) to avoid interference with the hole punch bits 30. In addition, linear and circularly arcuate lengthy openings 16*a* are individually formed on positions corresponding to the recessed cutout portions 12*c* of the metal cover 16. Similar to the recessed cutout portion 12*c*, the arcuate lengthy opening 16*a* forms an inductive guide space for avoiding interference with the hole punch bit 30 in the event that the metal cover 16 moves along the longitudinal direction of the paper-stacking base 12.

As shown in FIG. 1, the hole punch bit 30 is formed of a proximal end portion 30*a* having a large-diameter cylindrical structure, and a small-diameter cylindrical rod portion 30*b* formed in the proximal end portion 30*a* to extend along a central axis. The inside diameter of the proximal end portion 30*a* is set larger than the inside diameter of the rod portion 30*b*. An upper-end inner circumferential surface of the rod portion 30*b* forms a bit face having a sharp tip formed with a face tapered in the form of an upward skirt. The upper-end bit tip portion is disposed to extend through the recessed cutout portions 12*c* of the paper-stacking base 12 and the arcuate lengthy opening 16*a* of the metal cover 16.

The bit reception plate 20 is formed of a large-diameter discoidal main body 21, a supporting axis 22 extending along a central axial line of the main body 21, and a flange portion 23 fixed in an axial end portion of the supporting axis 22. A tip of the flange portion 23 has a substantially decapitated conical shape. A gear 23*a* is formed in an outer circumference of the flange portion 23. Individual central axial lines of the main body 21, supporting axis 22, and flange portion 23 are positioned along a same vertical line. The bit reception plate 20 is disposed to oppose an eccentric position with respect to the upper-end bit tip portion of the hole punch bit 30 and to be rotatable about a vertical axis line.

The elevating unit 14, having the bit reception plate 20, and an operation portion are provided as approaching/detaching means that causes the bit reception plate 20 to perform the approaching/detaching operation with respect to the upper-end bit tip portion of the hole punch bit 30. For the operation portion, mechanical driving mechanisms such as a rack-and-wormgear mechanism, ball-screw-and-nut mechanism, and link mechanism may be used as interlocking mechanism arranged to operate in association with the operation of the operating handle 15.

Alternatively, the operation portion may be constructed by using various actuators of hydraulic pressure, pneumatic pressure, and electric types. Thus, the operation portion may be of any type inasmuch as the portion has construction capable of transmitting an approaching force of the bit reception plate 20 to the hole punch bits 30, so that the invention is not limited to the specific embodiment.

In the present embodiment, the operating handle 15, which partly constitutes the operation portion, is fixedly supported by exposed end portions of a rotation axis 15*a* transversely supported between the supporting walls 13 to be freely rotatable. As shown in FIG. 3, a pair of pinion gears 15*b*, 15*b* are fixed with both end portions of the rotation axis 15*a* extending between opposite faces of the supporting walls 13. A pair of left and right linear rack gears 14*a*, 14*a* individually engaging the pinion gears 15*b* are fixed with the elevating unit 14. Consequently, when the operating handle 15 is rotated clockwise as viewed in FIG. 1, the elevating unit 14 moves down along the portion between the supporting walls 13. When the operating handle 15 is rotated counterclockwise as viewed in FIG. 1, the elevating unit 14 moves up along the portion between the supporting walls 13.

The moving means according to the typical embodiment of the invention are constructed as shown in FIGS. 1 and 2. The moving means are formed of a pair (two sets) of first and second parallel link mechanisms 50, 50 individually disposed parallel with each other between the base unit 11 and the paper-stacking base 12. The two sets of parallel link mechanisms 50 have a same construction, so that only one of the parallel link mechanisms 50 is described below. The other parallel link mechanism 50 is shown with the same member characters or numerals, but detailed description thereof is omitted herefrom.

The each parallel link mechanism 50 is constructed of an X-shaped parallel link formed such that central portions of first and second links 51, 51 are pin coupled so that the individual links 51 intersect with each other. With this construction, the vertical movement of the paper-stacking base 12 can be constantly maintained in a horizontal parallel state with respect to the base unit 11.

Two points of end portions vertically adjacent in the links 51 of the each set are supported on the base unit 11 and the paper-stacking base 12 as static contrapositive points to be freely rotatable. Accordingly, two points of the other free end portions are dynamic contrapositive points. The contrapositive points of the each link 51 are individually fixed with common supporting rods 52, 52. Transversely long circularly arcuate lengthy openings 11*a* and 12*d* are formed in left and right sidewall portions along a longitudinal direction of the base unit 11 and the paper-stacking base 12. In addition, both-side end portions of the supporting rods 52 of the each link are supported in the transversely long circularly arcuate lengthy openings 11*a* and 12*d* to be forwardly and rearwardly slidable along the longitudinal direction.

In addition, an extension spring 53 as return spring means for standing the parallel link mechanism 50 is interposed between a linear bar member 17 extending between the individual supporting walls 13 and a rear end of the paper-stacking base 12. The mounting position, mounting number, and the like of the return spring means can be appropriately set corresponding to the type, structure, and the like of the each parallel link mechanism 50. Thereby, smooth rotation of the each link can be ensured. For the return spring means of the link of the each set, for example, a compression spring can be used, or alternatively, a compression spring and an extension spring can be distinctively used.

At the time of approach of the bit reception plate 20, when the paper-stacking base 12 is descended by a pressure force generated with the descent of the elevating unit 14 and transferred from the bit reception plate 20, the parallel link mechanisms 50 descend together with an arbitrary number of to-be-punched paper sheets placed on the paper-stacking base 12 while maintaining the horizontal and parallel state with respect to the base unit 11. At the time of descent of the paper-stacking base 12, while to-be-punched paper sheets (not shown) placed on the paper-stacking base 12 are being intensively vertically clamped between the metal cover 16, which partly constitutes the paper-stacking base 12, and the bit reception plate 20, the paper sheets are punched by the hole punch bit 30. Of course, the moving means may be of any structure inasmuch as it moves parallel with the vertical direction, and the invention is not limited to the example shown in the drawings.

As shown in FIG. 1, a rectangular-plate-like vertical wall portion 12*e* having a slide guide opening 12*e*-1 is formed as being downwardly bent at the right angle in a frontward portion below the undersurface of the paper-stacking base 12 in a portion corresponding to the protruding portion 11*b* formed in the base unit 11. A guide bar 12*f* is crosslinked and fixed with left and right sidewall portions that are adjacent to the recessed cutout portions 12*c* of the paper-stacking base 12 and that are bent in the same direction to be opposite each other.

Exposed end portions on both sides of the guide bar 12*f* are slidably guided by vertically lengthy recessed guide portions 13*a* formed on the opposite faces of the supporting walls 13 of the base unit 11. As shown in FIG. 1, a pair of left/right stopper members 18, 18 of substantial reverse L shape are vertically mounted on a rear-side upper surface of the paper-stacking base 12. A bent end portion of each of the stopper members 18 is inserted into each of a pair of left/right vertically lengthy slit-like openings 14*b*, 14*b* formed in a central portion of the elevating unit 14.

Individual opening ends on upper and lower sides of the slit-like openings 14*b* are formed corresponding to ascending and descending limit positions for blocking the movement of the elevating unit 14. The each opening end thus formed has a functionality serving as an elevation regulation portion that regulates unnecessary elevation of the elevating unit 14. In association with the approaching operation of the bit reception plate 20, the above-described construction serves to enable the paper-stacking base 12 to perform elevation movement without leftward/rightward runout being caused. By way of example, the present embodiment presents the construction having the two stopper members 18 separately arranged in parallel. However, the stopper members 18 may be formed, for example, in the form of a frame unit having a connection plate between the bent end portions of the individual stopper members 18.

The present embodiment has been described with reference to the illustrated example in which the paper-stacking base 12 performs elevation movement between the slide guide opening 12*e*-1 and guide bar 12*f* of the paper-stacking base 12 and the protruding portion 11*b* and recessed guide portions 13*a* of the base unit 11. However, the invention is not limited by the illustrated embodiment. For example, the construction may be formed of cutouts, opening portions, cylindrical portions, and the like formed on one of the base unit 11 or paper-stacking base 12, and convex portions, insertion pins, rods, and the like formed on the other of the paper-stacking base 12 and base unit 11.

The above-described construction enables the paper-stacking base 12 to be inductively guided accurately and steadily. As a consequent, entanglements, deflection, and the like of the individual links, leftward/rightward runout, and the like can be prevented, and concurrently, smooth rotation can be accomplished, whereby the quality of the parallel link mechanism 50 is secured for a long time. In addition, it is a matter of course that the mounting positions, mounting numbers, and the like of these members are not limited to those in the illustrated example.

Figure 4:
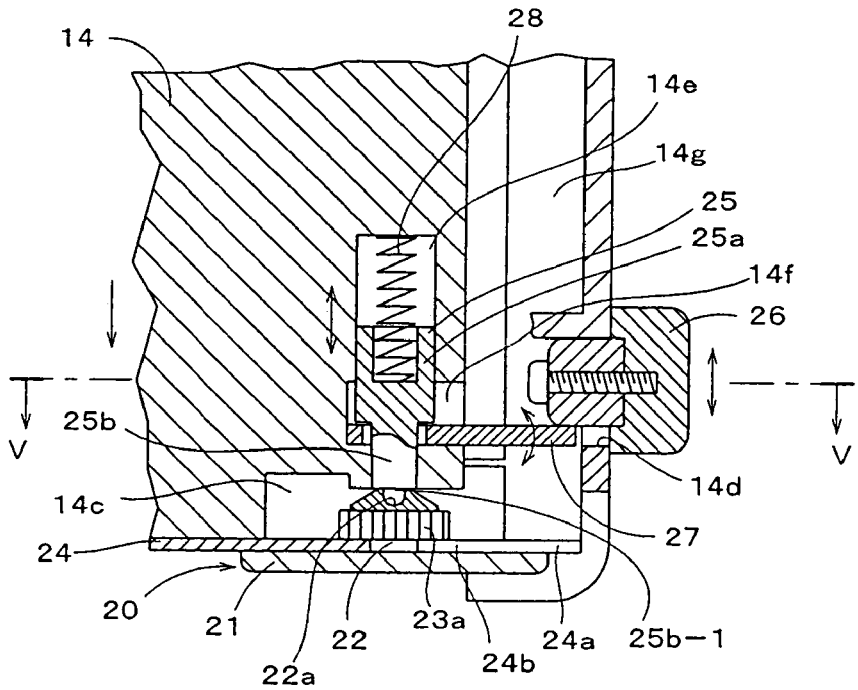
FIG. 4 is a major-portion vertical cross sectional view showing a vertical cutaway of major portions of an elevating unit of the punch apparatus.
Figure 5:
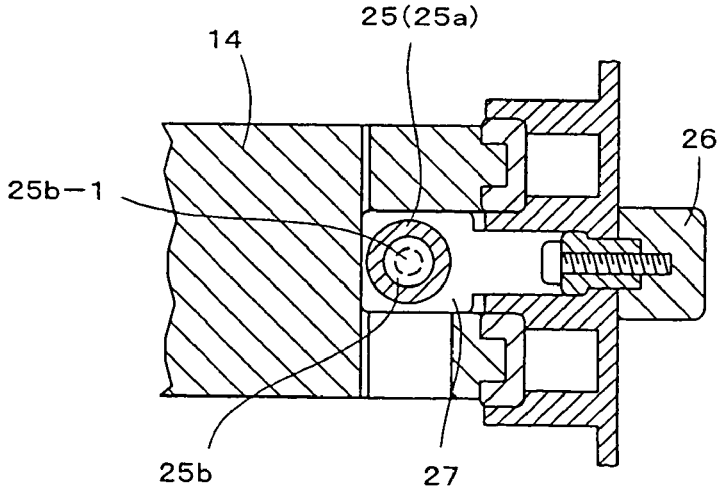
FIG. 5 is a cross sectional view taken along the line V-V of FIG. 4.

A first major feature portion of the invention lies in that the bit reception plate 20 is disposed insertably and removably with respect to the main body of the punch apparatus. In the paper punch apparatus 10 of the present embodiment, the bit reception plate 20 is disposed insertably and removably with respect to a lower bottom face of the elevating unit 14 partly constituting the main body of the paper punch apparatus. FIG. 4 is a major-portion vertical cross sectional view showing a vertical cutaway of major portions of the elevating unit; and FIG. 5 is a cross sectional view taken along the line V-V of FIG. 4.

With reference to these drawings, the elevating unit 14 is constructed of a block unit in the form of a vertically lengthy rectangular parallelepiped. In each of both sidewall portions (front and rear faces in the direction perpendicular to FIG. 1) in the lower end portion of the elevating unit 14, a supporting plate 24 is provided such that a plate surface thereof extends parallel with the lower bottom face of the elevating unit 14 with a predetermine gap. The supporting plate 24 constitutes an insertion/removal portion for insertion-supporting the supporting axis 22 of the bit reception plate 20 between the discoidal main body 21 and the flange portion 23. In addition, a flange-storage space 14*c* for storing the flange portion 23 is formed between the elevating unit 14 and the supporting plate 24.

On the supporting plate 24, the rectangular insertion opening 24*a* (FIG. 9) for insertion of the supporting axis 22 of the bit reception plate 20 is formed, and a slit-like opening 24*b* (FIG. 9) for supporting the supporting axis 22 is formed in communication with the insertion opening 24*a* on the same plane. An engagement/disengagement concave portion 22*a* is formed on a top portion of the flange portion 23. For engagement/disengagement between the bit reception plate 20 and the supporting plate 24, a bit-reception-plate engagement/disengagement portion that engages/disengages with respect to the engagement/disengagement concave portion 22*a* in the flange-storing space 14*c* is used.

The bit-reception-plate engagement/disengagement portion has an engagement/disengagement member 25 for positioning and supporting the bit reception plate 20 on the supporting plate 24, and an engagement/disengagement member manipulation portion for vertically moving the engagement/disengagement member 25. The engagement/disengagement member manipulation portion has a manipulation knob 26 and a strip-like oscillatory movement piece 27 used for engagement/disengagement between the engagement/disengagement member 25 and the bit reception plate 20.

In each of the both sidewall portions of the elevating unit 14, a vertically lengthy slit-like opening 14*d* matching the peripheral surface of the flange-storing space 14*c* is formed. The manipulation knob 26 is fixedly mounted to the slit-like opening 14*d* to be vertically movable, and is resiliently supported on an upper surface of a free end portion of the oscillatory movement piece 27.

As described above, each of the both sidewall portions in the lower end portion of the elevating unit 14 has the flange-storing space 14*c*, the supporting plate 24, and the engagement/disengagement member 25 that performs engagement/disengagement of an axis end of the rotation axis of the bit reception plate 20 in the flange-storing space 14*c*. Thereby, the bit reception plate 20 is enabled to perform insertion/detachment operation with respect to the flange-storing space 14*c* in parallel along a straight line, and the insertion/detachment of the bit reception plate 20 can be steadily and securely performed at all times.

As shown in FIGS. 4 and 5, the engagement/disengagement member 25 is formed of a large-diameter circularly cylindrical portion 25*a* and a small-diameter rod portion 25*b*. The rod portion 25*b* and the circularly cylindrical portion 25*a* are formed along a same central axis line via a stepped face therebetween. A rod end of the rod portion 25*b* has a ball-like engagement/disengagement protrusion 25*b*-1 that protrudes downwardly and that has a same shape as the engagement/disengagement concave portion 22*a* of the bit reception plate 20 that is engageable therewith. On the lower bottom face of the elevating unit 14, a vertically lengthy support space portion 14*e* for supporting the engagement/disengagement member 25 to be vertically movable is formed in a piercing manner.

As shown in FIG. 4, the support space portion 14*e* has a stepped shape having a stepped portion that has a circular support face for regulating the vertical movement of the engagement/disengagement member 25 in abutment with the stepped face thereof. The stepped face of the engagement/disengagement member 25 is positioned and resiliently supported on the circular support face of the support space portion 14*e* to be vertically movable in resistance with spring force of a compression spring 28. The engagement/disengagement protrusion 25*b*-1 of the engagement/disengagement member 25 is inserted into the engagement/disengagement concave portion 22*a* of the bit reception plate 20.

As shown in FIG. 4, the oscillatory movement piece 27 is inserted across the support space portion 14*e* into a portion ranging from a transverse through-hole 14*f*, which is formed in parallel with the flange-storing space 14*c*, to a vertically lengthy manipulation space portion 14*g* perpendicularly merging on a vertical plane with respect to the flange-storing space 14*c*, thereby resiliently and oscillatorily moving toward the engagement/disengagement concave portion 22*a* with an intermediate position of the transverse through-hole 14*f* as an oscillatory movement supporting point.

As shown in FIG. 4, the engagement/disengagement member 25 is constantly urged down by the spring force of the compression spring 28. Press-down force of the compression spring 28 is received in the state where the circularly cylindrical portion 25*a* of the engagement/disengagement member 25 engages the circular support face of the support space portion 14*e* via the oscillatory movement piece 27. In this case, the free end portion of the oscillatory movement piece 27 causes the manipulation knob 26 to be static at a stationary position. Upon vertical sliding operation of the manipulation knob 26, oscillatory movement occurs with the intermediate position of the oscillatory movement piece 27 as the oscillatory-movement supporting point, whereby engagement is established between the engagement/disengagement concave portion 22*a* of the bit reception plate 20 and the engagement/disengagement protrusion 25*b*-1 of the engagement/disengagement member 25.

As described above, the engagement/disengagement member 25 is supported to be oscillatorily movable in the direction perpendicular to the direction of insertion/detachment of the bit reception plate 20 whereby to bring the bit reception plate 20 into resilient engagement/disengagement. Consequently, when the manipulation knob 26 is manipulated in the lower direction perpendicular to the direction of insertion/detachment of the bit reception plate 20, the engagement between the engagement/disengagement concave portion 22*a* of the bit reception plate 20 and the engagement/disengagement protrusion 25*b*-1 of the engagement/disengagement member 25 can be released. As such, although the structure is simple, the bit reception plate 20 can be operated smoothly, steadily, and securely at all times. In addition, handling of the bit reception plate 20 is easy, so that the insertion/detachment of the bit reception plate 20 can easily be performed.

It is a matter of course that the bit reception plate 20 can be supported transversely rotatably. To accomplish this, the spring force of the compression spring 28 for urging the engagement/disengagement member 25 in the lower direction is preliminarily set, and the engagement/disengagement concave portion 22*a* of the bit reception plate 20 and the engagement/disengagement protrusion 25*b*-1 of the engagement/disengagement member 25 are engageably supported.

A second major feature portion of the invention lies in that a hole-punch-bit support unit 31 for immobilizably supporting the hole punch bit 30 is disposed to be attachable and removable with respect to the main body of the paper punch apparatus. In the punch apparatus 10 according to the invention, the hole-punch-bit support unit 31 is disposed attachably and removably with respect to the base unit 11.

Figure 6:
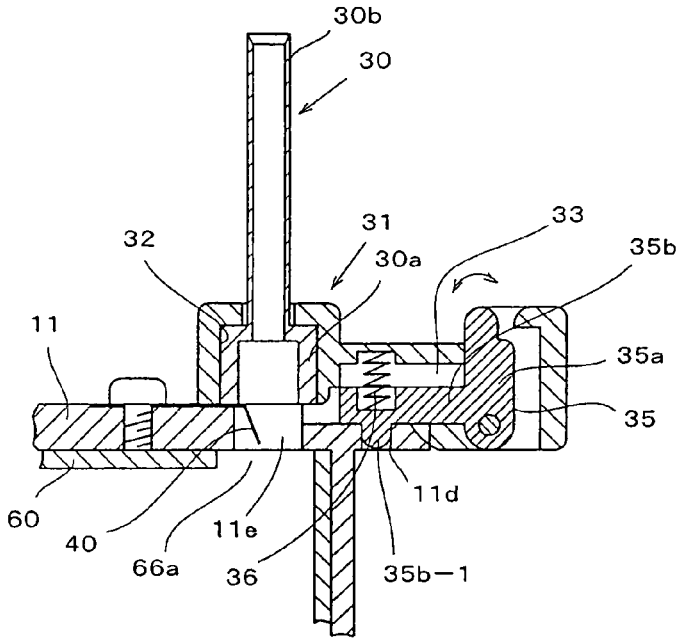
FIG. 6 is a major-portion vertical sectional view showing a vertical cutaway of major portions of a hole-punch-bit support unit of the punch apparatus.
Figure 7:
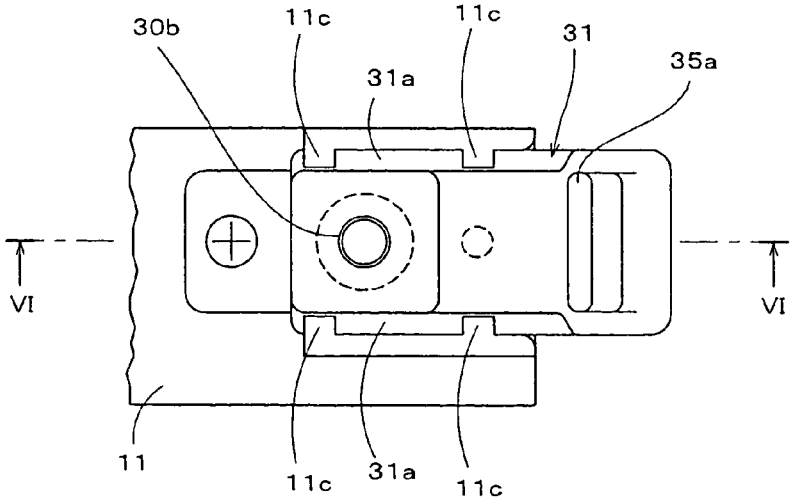
FIG. 7 is a plan view of the hole-punch-bit support unit of the paper punch apparatus.
Figure 8:
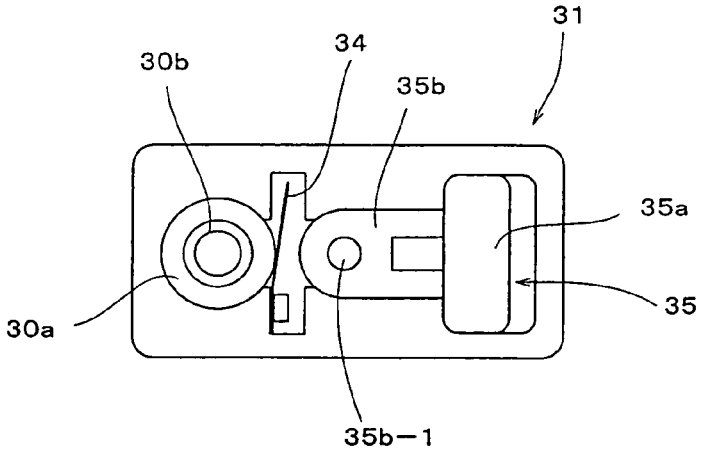
FIG. 8 is a rear view of the hole punch bit support unit.

FIGS. 6 to 8 shows an example structure of a hole-punch-bit support unit 31. FIG. 6 is a major-portion vertical sectional view showing major portions of the hole-punch-bit support unit 31 partly constituting the punch apparatus 10; FIG. 7 is a plan view of the hole-punch-bit support unit 31; and FIG. 8 is a rear view of the hole-punch-bit support unit 31. More specifically, FIG. 6 shows a cross section taken along the line VI-VI of FIG. 7.

Referring to these drawing figures, the hole-punch-bit support unit 31 is formed of a die-cast mold in the form of a lengthy shell unit that has wall portions formed in front and rear and left and right portions of a flat upper surface and that has an opened bottom portion. Referring to FIG. 7, as insertion/detachment guide portions for the hole-punch-bit support unit 31, a pair of front and rear guide pieces 11*c*, 11*c* are intermittently formed in the left-right direction of the base unit 11. More specifically, the guide pieces 11*c* each have a substantially reverse L shape and a substantially same dimension as the width of the hole-punch-bit support unit 31, and are formed in both side portions in the left-right direction (perpendicular to FIG. 1) of the base unit 11. Additionally, referring to FIG. 6, as an engagement portion of the hole-punch-bit support unit 31, an engagement opening portion 11*d* vertically piercing is formed between the guide pieces 11*c* of the base unit 11.

As shown in FIG. 7, flanges 31*a*, 31*a* to be attached and removed with respect to the guide pieces 11*c* are formed in lower end edges of left and right wall portions of the hole-punch-bit support unit 31. A hole-punch-bit support portion 32 is formed inside the hole-punch-bit support unit 31 in the form of a circular cylindrical structure that has an insertion opening for insertion-supporting the proximal end portion 30*a* of the hole punch bit 30. In this case, the proximal end portion 30*a* is inserted from the lower portion of the opening. In addition, a rectangularly cylindrical insertion/detachment space portion 33 is formed in the position corresponding to the engagement hole portion 11*d* of the base unit 11.

As shown in FIG. 8, a presser bar leaf spring 34 for preventing loose-out of the hole punch bit 30 is provided in such a manner that one end thereof is fixed and a free end portion thereof resiliently abuts the proximal end portion 30*a* of the hole punch bit 30 whereby to support the same.

As shown in FIG. 6, inside the insertion/detachment space portion 33, an oscillatory movement member 35 having a substantially L shaped cross section and constituting the insertion/detachment manipulation portion is fixedly supported to be rotatable around a horizontal axis line with a bent portion in the rotational center. The oscillatory movement member 35 has a rectangular-plate-like manipulation piece 35*a* disposed on a side of oscillatory-movement supporting point, and an engagement/disengagement member 35*b* extending in an oscillation direction perpendicular to the manipulation piece 35*a*.

A compression spring 36 is interposed between a pair of upper and lower concave portions that individually having circular cross sections and that are formed to oppose an upper surface of the engagement/disengagement member 35*b* and an inner upper surface of the hole-punch-bit support unit 31. The engagement/disengagement member 35*b* is constantly urged down by the spring force of the compression spring 36.

As shown in FIG. 6, on an undersurface of a oscillatory movement end of the engagement/disengagement member 35*b*, an engagement/disengagement protrusion **35*b*-1 is formed to have a height insertable into the engagement hole portion 11*d* of the base unit 11. When the hole-punch-bit support unit 31 is at an insertion limit position of the base unit 11, the engagement/disengagement protrusion 35*b*-1 is resiliently inserted into the engagement hole portion 11*d* for engagement. In this construction, when withdrawing the hole-punch-bit support unit 31 from the base unit 11, the manipulation piece 35*a* is pushed in the same direction as the drawing direction, whereby the engagement between the engagement hole portion 11*d* and the engagement/disengagement protrusion 35*b*-1** is resiliently released.

In this construction, the engagement/disengagement protrusion **35*b*-1 of the engagement/disengagement member 35*b* supported to be oscillatory movable in the direction perpendicular to the insertion/detachment direction of the hole-punch-bit support unit 31 is resiliently engaged with the engagement hole portion 11*d*. As such, by manipulating the manipulation piece 35*a* in the same direction as the withdrawal direction of the hole-punch-bit support unit 31, the engagement between the engagement hole portion 11*d* and the engagement/disengagement protrusion 35*b*-1** can easily be released, and replacement operation therefor can quickly be performed.

As described above, since the structure of the hole-punch-bit support unit 31 can be formed to be compact, the miniaturization, compaction, and the like of the overall apparatus can be securely implemented. When the manipulation piece **35*a* is pushed in the same direction as the withdrawal direction of the hole-punch-bit support unit 31, the engagement between the engagement hole portion 11*d* and the engagement/disengagement protrusion 35*b*-1** can be automatically released.

With the above arrangement, although the structure is simple, the hole-punch-bit support unit 31 can be operated smoothly, steadily, and securely at all times with respect to the base unit 11, and handling thereof is very easy.

Further, the paper punch apparatus 10 of the present embodiment uses a fall inhibition mechanism that inhibits falling of circular punched paper scraps (not shown) accumulating in the hole punch bit 30. As shown in FIG. 6, the fall inhibition mechanism has a leaf spring member 40. As shown in FIG. 1, a portion of the base unit 11 is formed as being a case of which an end portion in a longitudinal direction is opened, and a space portion thereof is used as a storage space portion of a scrap collection receptacle 60.

A punched-paper-scrap falling opening **11*e* vertically communicating with the storage space portion of the scrap collection receptacle 60 is formed in the fixedly mounted position of the proximal end portion 30*a* of the hole punch bit 30 on the base unit 11. The main body side of the leaf spring member 40 is tightened and fixed with a mounting screw onto the base unit 11, and a free end thereof is bent down and is interposed between the opening 11*e* of the base unit 11 and an opening end portion 66*a* on the base-unit supporting side of the hole punch bit 30**.

When the inside of the hole punch bit 30 is pushed, punched paper scraps being about to fall are accumulated on an upper surface of the leaf spring member 40, whereby falling of punched paper scraps can be inhibited by the spring force of the leaf spring member 40. As paper-hole punching operations are repeatedly performed and a predetermined quantity of punched paper scraps is accumulated, the punched paper scraps accumulated in the hole punch bit 30 overcome the spring force of the leaf spring member 40. The scraps thus cause the free end portion of the leaf spring member 40 to deflect down, and then fall from the opening on the base end side of the hole punch bit 30. The fallen punched paper scraps are directly stored into the scrap collection receptacle 60.

Thus, falling of punched paper scraps accumulating in the hole punch bit 30 can be inhibited through the leaf spring member 40. Consequently, at the time of, for example, hole punch operation, replacement of the hole punch bit 30, or withdrawal of the scrap collection receptacle 60, punched paper scraps accumulating in the hole punch bit 30 can be prevented from falling and scattering to the outside from the opening on the side of the proximal end portion of the hole punch bit 30.

Thereby, for example, punched paper scraps accumulating in the hole punch bit 30 can be prevented from scattering to the outside and from adhering to peripheral mechanisms such as the approaching/detaching means whereby deteriorating the operability thereof. Consequently, the paper-stacking base 12, or a worktable (not shown) can be maintained cleaned at all times. Further, the operability of the apparatus can be enhanced to perform the paper hole punch operation quickly and easily.

A third major feature portion of the invention lies in that it has an automatic rotation mechanism 70 that rotates the bit reception plate 20 by a predetermined angle. In the present embodiment, the automatic rotation mechanism 70, which rotates the bit reception plate 20 by a predetermined angle in association with the vertical movement of the elevating unit 14, is disposed in the flange-storing space **14*c* formed between the supporting plate 24 and the elevating unit 14**.

Figure 9:
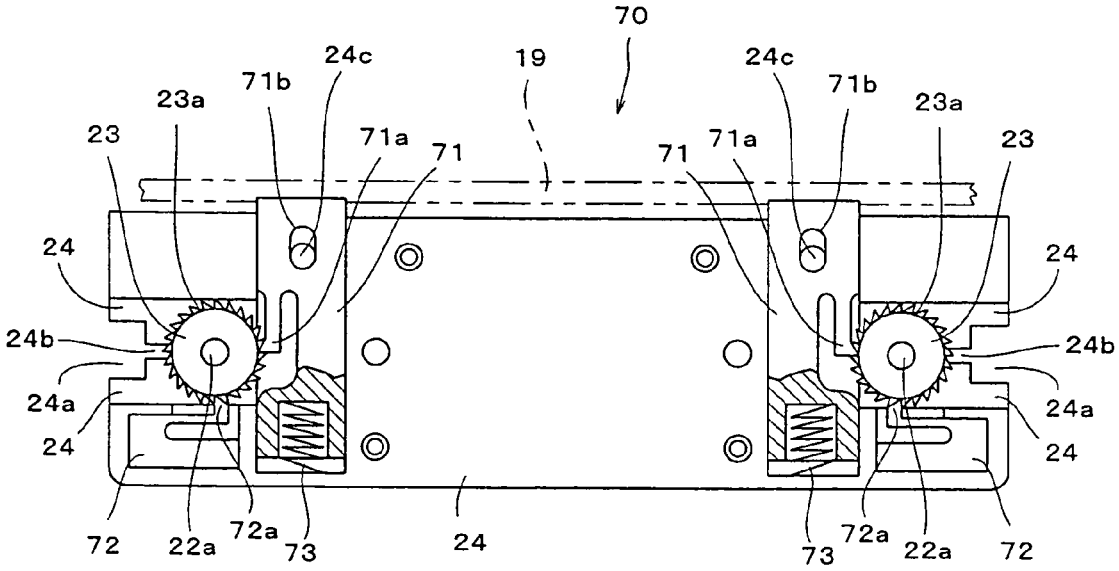
FIG. 9 is a schematic major-portion transverse sectional view showing a transverse cutaway of major portions of an interior structure of an automatic rotation mechanism for a bit reception plate of the punch apparatus.

FIG. 9 is a major-portion transverse sectional view showing a cutaway of major portions of the automatic rotation mechanism 70 for the bit reception plate 20, and more specifically, it schematically shows an interior construction of the automatic rotation mechanism 70.

Referring to the drawing figure, the automatic rotation mechanism 70 for the bit reception plates 20 has a pair of left and right rectangular-plate-like engagement/disengagement members 71, 71 disposed on the same plane as the flange portions 23 of the bit reception plates 20 on the supporting plate 24, and detent members 72, 72 for the bit reception plates 20 that are disposed perpendicular to the engagement/disengagement members 71. A lengthy opening **71*b* is formed in the engagement/disengagement member 71, and the lengthy opening 71*b* is engaged with a protruding pin 24*c* formed to extend on an upper surface of the supporting plate 24**.

A resilient engagement detent **71*a* extending along a rotational direction of the gear 23*a* is provided to the sidewall of the engagement/disengagement member 71 that opposes the gear 23*a* formed on the outer circumference of the flange portion 23 of the bit reception plate 20. A tip engagement face of the resilient engagement detent 71*a* engages the gear 23*a*. The engagement/disengagement members 71 is formed to be resiliently pushed to the elevating unit 14 by a cam surface of a cam plate 19, which is shown in FIGS. 1 and 3 and is fixedly mounted between the opposite faces of the individual supporting walls 13**.

Accordingly, in association with the vertical movement of the elevating unit 14, the tip engagement face of the resilient engagement detent **71*a* moves in the direction of engagement with the gear 23*a*. Thereby, the tip engagement face engages the gear 23*a*. Further, the resilient engagement detent 71*a* is pushed by the cam surface of the cam plate 19 to move down as viewed in FIG. 9. Thereby, the gear 23*a* is rotated by one pitch, and the bit reception plate 20 can be rotated by one pitch through the gear 23*a***.

On the sidewall of one of the detent members 72 opposing the gear 23*a*, a resilient engagement detent 72*a* extending to the opposite side of the gear rotation direction is provided, and a tip engagement face of the resilient engagement detent 72*a* is engaged with the gear 23*a* that stops backward rotation of the gear 23*a*.

In the engagement/disengagement member 71, a compression spring 73 is provided between the engagement/disengagement member 71 and the supporting plate 24, whereby the engagement/disengagement member 71 is urged outward the elevating unit-14 at all times by the spring force of the compression spring 73. The spring force of the compression spring 73 is received by the lengthy opening 71*b* of the engagement/disengagement member 71, whereby the gear 23*a* is held in a static state.

It is now assumed that the elevating unit 14 is descended. In this case, the engagement/disengagement member 71 is moved to leave from the cam plate 19 fixedly mounted between the opposite faces of the individual supporting walls 13, and is then outwardly urged by the spring force of the compression spring 73. Even at this event, the resilient engagement detent 72*a* of the detent member 72 is still engaged with the gear 23*a*. For this reason, while the resilient engagement detent 71*a* of the engagement/disengagement member 71 is being resiliently deflected in an extension direction releasing the engagement with the gear 23*a*, the gear 23*a* passes the tip engagement face of the resilient engagement detent 71*a* of the engagement/disengagement member 71. The deflection resisting the resilience of the resilient engagement detent 71*a* resiliently returns to a portion between the gears, and the engagement is then established between the gear 23*a* and the resilient engagement detent 71*a*. In this engagement state, further rotation is stopped, and the rotation of the bit reception plate 20 is automatically stopped.

Conversely, when the elevating unit 14 is ascended, the engagement/disengagement member 71 is resiliently urged by the cam surface of the cam plate 19 to the inside of the elevating unit 14. In this event, the resilient engagement detent 72*a* of the detent member 72 leaves the gear 23*a*, and the engagement state between the detent member 72 and the gear 23*a* is released. At the event of the release, the resilient engagement detent 71*a* of the engagement/disengagement member 71 pushes the gear 23*a*, thereby causing the bit reception plate 20 to automatically rotate by one pitch at a predetermined rotation angle.

Thus, the present embodiment has the construction that rotates the bit reception plate 20 at the predetermined angle in association with the vertical movement of the bit reception plate 20. As such, an intricate interlocking mechanism such as the conventional one can be avoided, and a compact construction can be implemented by intensively disposing the simply structured automatic rotation mechanism 70 on the same plane as the bit reception plate 20.

Thus, the present embodiment is described with reference to the illustrated example structure of the automatic rotation mechanism 70 having the gears 23*a* and the resilient engagement detents 71*a*. However, the invention is not limited to the illustrated example. The construction may be of any type inasmuch as the construction is capable of rotating the bit reception plate 20 and is engageable/disengageable with respect to the bit reception plate 20, so that the structure, pattern, and the like thereof are not particularly limited.

For the engagement/disengagement member, various structures having, for example, a ratchet detent or the like similar to the resilient engagement detent may be employed. The gear 23*a* may be formed on the periphery of the bit reception plate 20. For the engagement/disengagement member 71, an operational detent of a general type for resilient engagement/disengagement with respect to a ratchet tooth may be used.

Accordingly, the engagement/disengagement member 71 may be of a structure similar to a simple rectangular plate piece, so that it need not be formed into an intricate structure. Since an intricate interlocking mechanism can be avoided, reduction of costs such as assembly costs, manufacturing costs, and material costs can be implemented in conjunction with the reduction of components of the automatic rotation mechanism 70. In addition, miniaturization, compaction, weight reduction, and thickness reduction of the overall apparatus can be securely implemented.

With the automatic rotation mechanism 70 being employed, while the structure is simple, the paper punch position, punch hole size, pattern, and the like can be accurately and steadily ensured at all times. Thereby, the quality of, for example, the bit reception plate 20, the hole punch bits 30, and the like can be enhanced, and safety, reliability, and the like thereof in use time can be significantly improved. Further, the handling thereof can be made easy.

Further, a fourth major feature portion of the invention lies in the structure and pattern of the scrap collection receptacle 60. The paper punch apparatus 10 of the present embodiment has the scrap collection receptacle 60 of a synthetic resin for collecting punched paper scraps discharged from a cylinder in the proximal end portion of the hole punch bit 30. The scrap collection receptacle 60 is accommodated in a receptacle accommodation space of the base unit 11 to be attachable and removable.

Figure 10:
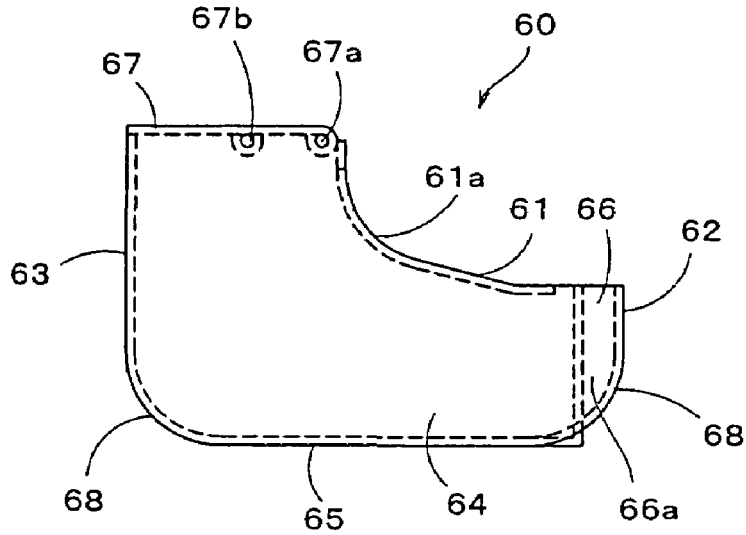
FIG. 10 is a side view of a scrap collection receptacle of the punch apparatus.
Figure 11:
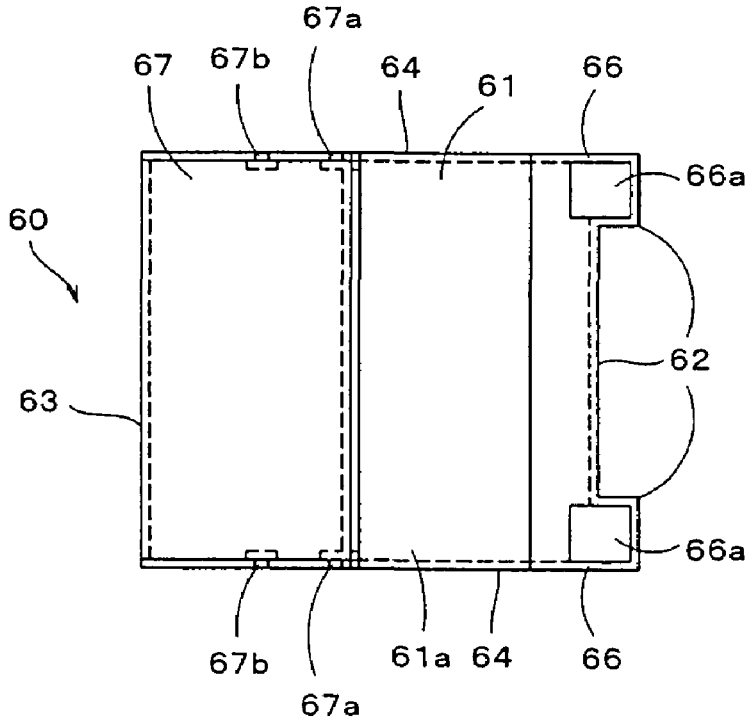
FIG. 11 is a plan view of the scrap collection receptacle.

FIGS. 10 and 11 show the scrap collection receptacle. With reference to these drawing figures, the scrap collection receptacle 60 has flat upper wall surfaces on a withdrawal side and an insertion side in front and rear portions of the arcuately concave circular arc upper wall surface 61*a* in a ceiling wall portion 61. The ceiling wall portion 61 has front and rear sidewall portions 62 and 63, left and right sidewall portions 64, 64 and a bottom wall portion 65. In corner portions of the front sidewall portions 62 and the left and right sidewall portions 64 of the scrap collection receptacle 60, there are protrusively provided a pair of left and right expansion portions 66, 66 each having a cross section arcuate toward the bottom face of the bottom wall portion 65. Upper surfaces of the expansion portions 66 are used as punched paper scrap inlets 66*a* rectangularly formed.

When the receptacle is mounted, the inlet 66*a* is situated immediately below the opening 11*e* of the base unit 11, which is formed corresponding to the opening end portion of the proximal end portion 30*a* of the hole punch bit 30. As such, punched paper scraps accumulating in the hole punch bit 30 is pushed, and concurrently, can be caused to directly fall into the scrap collection receptacle 60. Thereby, such cases do not occur in which punched paper scraps fall and scatter in peripheral portions of the paper-stacking base 12, make portions such as paper-stacking base 12 and work table to be unclean, and adhere to peripheral mechanisms whereby deteriorating operabilities thereof.

As shown in FIGS. 10 and 11, the upper wall surface on the withdrawal side of the ceiling wall portion 61 is formed of an open/close lid unit 67 that vertically opens/closes. The open/close lid unit 67 is supported on the left and right sidewall portions 64 adjacent to an apex of the concave upper wall surface 61*a* of the ceiling wall portion 61 to be rotatable via hinge portions 67*a*, and fixedly mounted via engagement portions 67*b* to be openable and closable. The engagement portion 67*b* is formed of an engagement concave portion formed in one of the open/close lid unit 67 and the left and right sidewall portions 64 and a protruding portion formed in the other one of the left and right sidewall portions 64 and the open/close lid unit 67.

The front and rear sidewall portions 62 and 63, corner portions 68 of the left and right sidewall portions 64 and bottom wall portion 65, and the concave upper wall surfaces 61*a* are formed into concavely curved faces. The inside of the scrap collection receptacle 60 is formed so as to gradually expand from the side of the punched-paper-scrap inlet 66*a* to the side of the open/close lid unit 67.

The inside of the scrap collection receptacle 60 is formed by being completely covered by the ceiling wall portion 61, except the punched-paper-scrap inlets 66*a*, so as not to be exposed to the outside. This enables preventing such cases in which at the time of carrying the apparatus and at the time of withdrawing the scrap collection receptacle 60, punched paper scraps stored in the scrap collection receptacle 60 scatter and make a work table and peripheral portions of the work table to be unclean, and adhere to peripheral mechanisms whereby deteriorating operabilities thereof.

Further, the inside of the scrap collection receptacle 60 is formed into the curved faces arcuate to the side of the open/close lid unit 67. As such, punched paper scraps collected into the scrap collection receptacle 60 from an undersurface opening end of the proximal end portion 30*a* of the hole punch bit 30 can be moved smoothly, easily, and securely to the side of the open/close lid unit 67 from the side of the punched-paper-scrap inlet 66*a* along the curved face. Consequently, when the scrap collection receptacle 60 has become full, agglomerated punched paper scraps push up the open/close lid unit 67 with the hinge portions 67*a* as a rotation center. Thereby, punched paper scraps can be prevented from being jammed in the hole punch bit 30, and hence the hole punch bit 30 can be prevented from, for example, being deformed and damaged.

According to the invention, since the hole punch bit 30 is disposed in immobile manner with respect to the base unit 11, punched paper scraps accumulated in the hole punch bit 30 can be directly pushed down to fall. As such, punched paper scraps do not fall and scatter to, for example, the paper-stacking base 12 and peripheral portions thereof, so that punched paper scraps can be prevented from, for example, making portions such as the paper-stacking base and the peripheral portions thereof to be unclean and adhering to peripheral mechanisms whereby deteriorating the operabilities thereof. Accordingly, cleaning work for paper need not be done at all times, and the punching operation into one or more paper sheets can be quickly, smoothly, and easily performed.

Further, a fifth major feature portion of the invention lies in that it has a paper abutment member 80 that enables the paper punch position to be arbitrarily changed. The punch apparatus 10 of the present embodiment has the paper abutment member 80 on the paper-stacking base 12.

Figure 12:
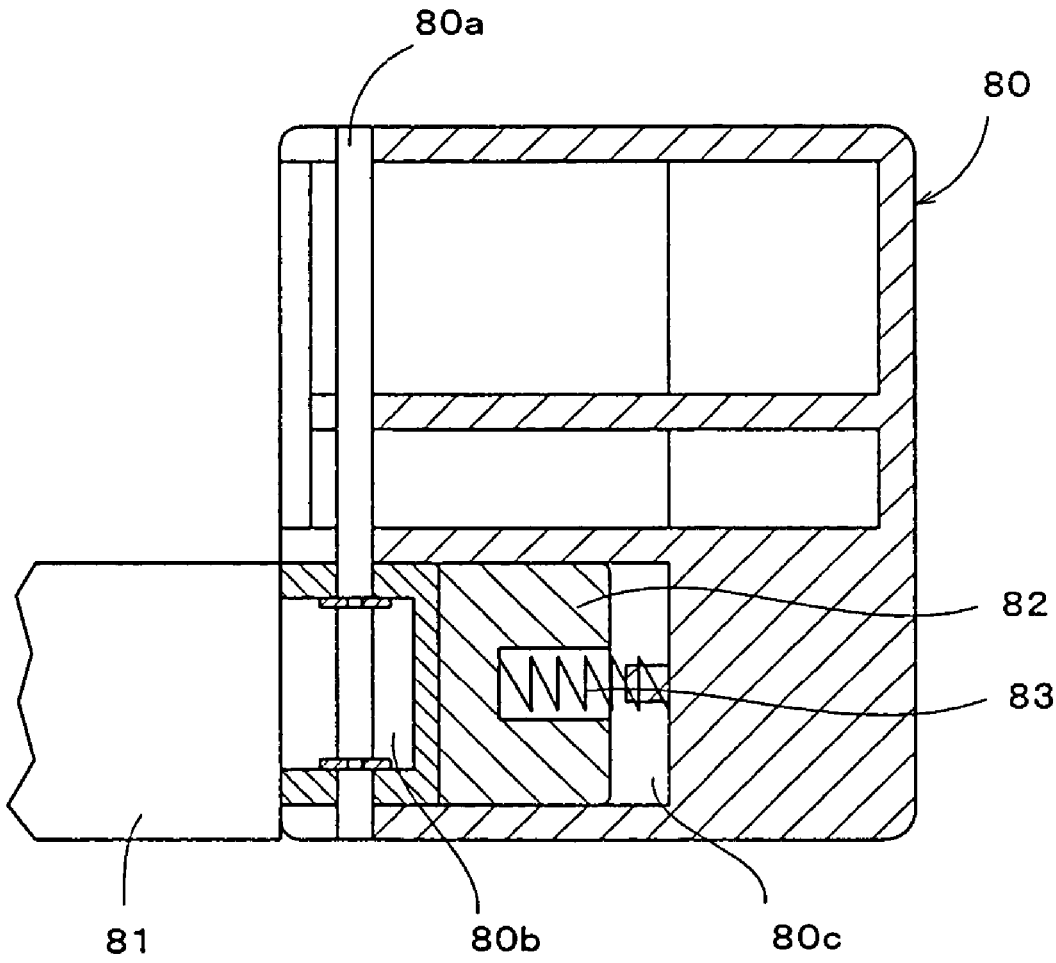
FIG. 12 is a schematic transverse sectional view of a paper abutment member of the punch apparatus.
Figure 13:
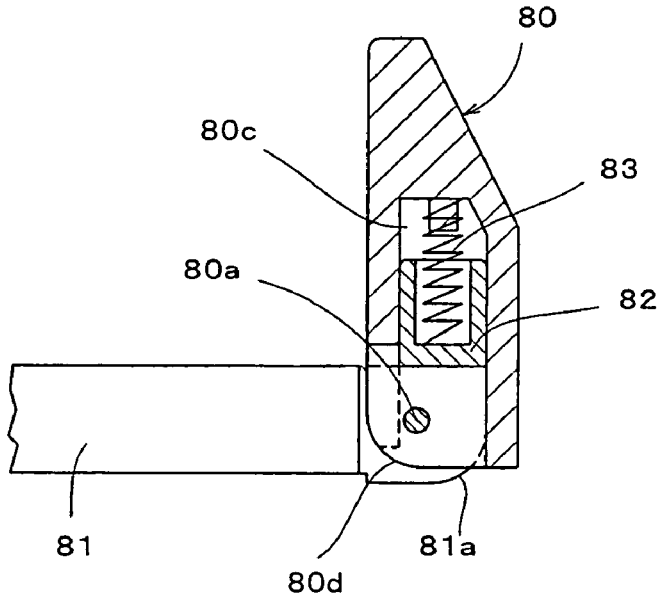
FIG. 13 is a schematic major-portion vertical sectional view of an erect state of the paper abutment member of the punch apparatus.
Figure 14:
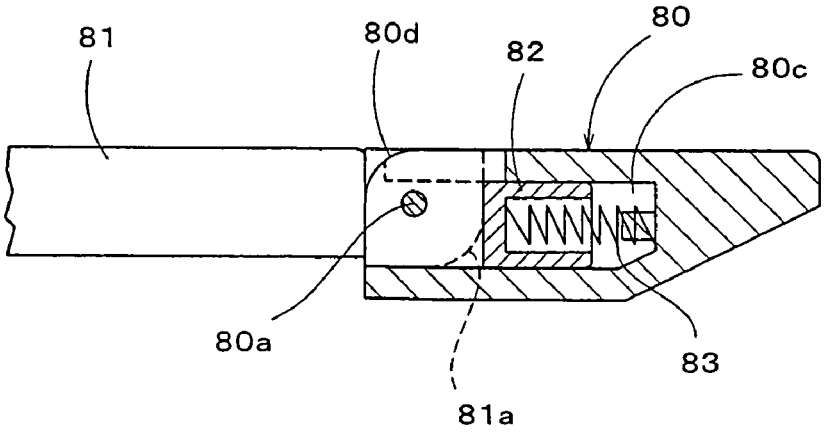
FIG. 14 is a schematic major-portion vertical sectional view of a laid-down state of the paper abutment member.

FIGS. 12 to 14 schematically show the paper abutment member 80. FIG. 12 is a schematic transverse sectional view showing the paper abutment member 80; FIG. 13 is a schematic major-portion vertical sectional view showing an erected state of the paper abutment member 86; and FIG. 14 is a schematic major-portion vertical sectional view showing a laid-down state of the paper abutment member 80.

With reference to these drawing figures, in both left and right side end portions of the paper-stacking base 12, a pair of front and rear side gauge racks 81 for engaging a common pinion (not shown) are disposed to be movable to sides opposite to each other in the left and right directions of the base unit 11. On an edge face of the side gauge rack 81, the paper abutment member 80 is supported rotatably in the direction perpendicular to the side gauge rack 81 via a supporting axis 80*a*.

In the paper abutment member 80, a recessed insertion opening 80*b* for accommodating an end of the side gauge rack 81 is formed, and a plan-view rectangular space portion 80*c* continuing from one plane of the insertion opening 80*b* to an axis line in the longitudinal direction of the side gauge rack 81 is formed.

In the rectangular space portion 80*c*, there is accommodated via a compression spring 83 a stopper member that brings the paper abutment member 80 into resilient abutment with the edge face of the side gauge rack 81 whereby to position the paper abutment member 80 at two positions: an erection position perpendicular to the side gauge rack 81 and a lay-down position along the axis line in the longitudinal direction of the side gauge rack 81.

Figure 15:
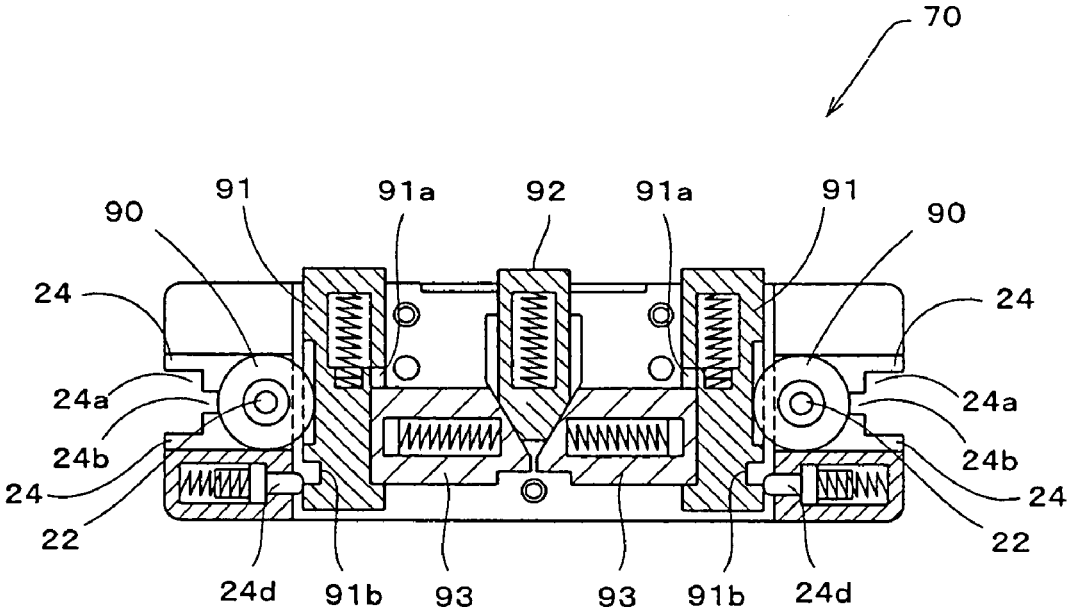
FIG. 15 is a schematic major-portion transverse sectional view showing a transverse cutaway of major portions of an interior structure of a modified example of an automatic rotation mechanism for the bit reception plate of the punch apparatus.

As shown in FIGS. 14 and 15, a lower end corner portion of the end portion of the side gauge rack 81 has a first rotation guide face 81*a* of the paper abutment member 80, and the paper abutment member 80 has a second rotation guide face 80*d* for the side gauge rack 81. Each of the rotation guide faces 80*d* and 81*a* has an arcuate-face shaped cross section with the supporting axis 80*a* in the center, and is formed such that the paper abutment member 80 smoothly rotates with respect to the side gauge rack 81.

When the paper abutment member 80 rotates from a laid-down state to an erection direction perpendicular to the paper abutment member 80, the paper abutment member 80 is erected by being pushed on the edge face of the side gauge rack 81 in resistance with the spring force of the compression spring 83. More specifically, when the stopper member 82 passes over the upper-end corner portion of the side gauge rack 81, the paper abutment member 80 is synchronously engaged with an end-portion upper face of the side gauge rack 81 via the compression spring 83. In this engagement state, even when trying to further rotate the paper abutment member 80, the stopper member 82 abuts the end-portion upper face of the side gauge rack 81 whereby to regulate the further rotation of the paper abutment member 80.

By way of an example case of forming holes by arbitrarily choosing such factors as the number of punch holes, suppose that a double-hole forming punch apparatus 10 is used to form four holes into A4-size paper sheet along the same straight line. In this case, one paper abutment member 80 is held in the erected state with respect to the side gauge racks 81, and the other paper abutment member 80 is held in the laid-down state with respect to the side gauge racks 81. Subsequently, an upper edge of the A4-size paper sheet is positioned on a paper abutment face of the erected paper abutment member 80, and the paper sheet is then punched, whereby two holes are formed at predetermined positions of the A4-size paper sheet. Subsequently, the A4-size paper sheet is turned upside down along the two holes, the lower edge of the A4-size paper sheet is positioned on the paper abutment face of the paper abutment member 80, and the paper sheet is then punched. In this manner, four holes can be formed along the same straight line at predetermined intervals in the A4-size paper sheet.

Four holes can be formed along the same straight line at predetermined intervals in the A4-size paper sheet in a different manner. In this case, after two holes have been formed in the A4-size paper sheet, the erected paper abutment member 80 is laid down without turning the A4-size paper sheet upside down, the other paper abutment member 80 in the laid-down state is erected, and operations similar to the above are repeatedly performed.

In the paper abutment structures, the pair of side gauge racks 81 are disposed to be movable in opposition to each other along the left and right directions of the base unit 11. As such, while the center of to-be-punched paper can of course be positioned, the paper abutment member 80 of the each side gauge rack 81 can be independently positioned at two positions: the erection position perpendicular to the side gauge rack 81 and the lay-down position along the axis line in the longitudinal direction thereof.

Accordingly, regardless of the size of to-be-punched paper, holes can be formed by arbitrarily choosing, for example, the same punch positions and number of punch holes with the upper edge or lower edge of paper being used as a reference. Consequently, paper sheets can be bound in a desired arrangement pattern. For example, papers can be arranged and bound in the form of a file in, for example, a pattern in which lower edges of A4-size paper sheets and B5-size paper sheets are aligned, or upper edges of A4-size paper sheets and B5-size paper sheets are aligned.

Figure 16:
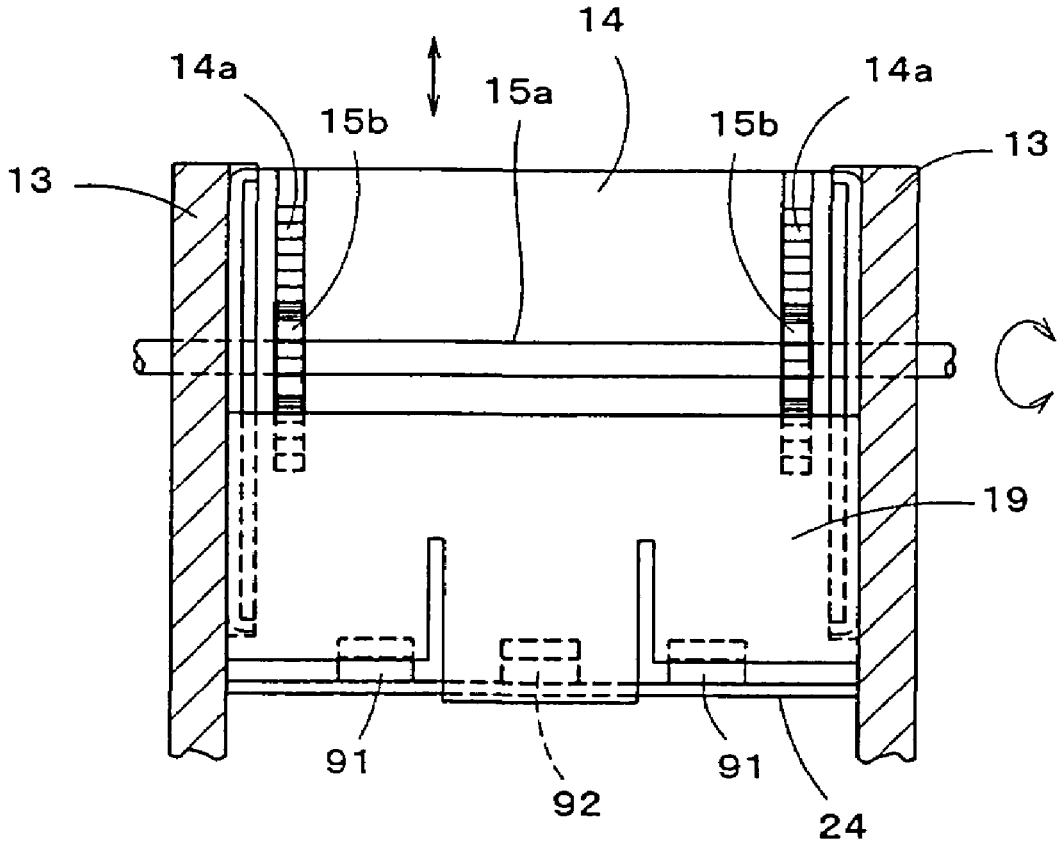
FIG. 16 is a schematic rear view showing a rear side of the punch apparatus using the automatic rotation mechanism.

With reference to FIGS. 15 and 16, a modified example of an automatic rotation mechanism for the bit reception plate according to the invention will be described below. FIG. 15 is a schematic major-portion transverse sectional view showing a cutaway of major portions of an interior structure of the modified example of the automatic rotation mechanism. FIG. 16 is a schematic rear view showing a rear side of a paper punch apparatus adapted to the automatic rotation mechanism. In the drawing figures, the same names and reference numerals are used for the substantially same members, and detailed descriptions thereof will be omitted herefrom.

In the modified example, an additional feature portion of the automatic rotation mechanism 70 for the bit reception plate 20 lies in the use of an engagement/disengagement mechanism of the type formed to include pinions 90 for rotating the bit reception plates 20 and linear racks 91 that rotate the bit reception plates 20 by a predetermined angle in one direction. The engagement/disengagement mechanism is the type that performs engagement/disengagement between the bit reception plates 20 and the racks 91 formed of plate members in association with pressing operation of a second engagement/disengagement member 92 formed of a plate member.

Referring to FIG. 15, the engagement/disengagement mechanism has a second engagement/disengagement member 92 disposed on the same plane as a pair of left and right racks 91, 91; interlocking members 93 formed of plate members and disposed perpendicular to the movement direction of the second engagement/disengagement member 92; and return spring members disposed on sides opposite the interlocking members 93 in such a manner as to sandwich the linear racks 91.

As shown in FIG. 15, the second engagement/disengagement member 92 resiliently moves independently of and in the same direction as the linear racks 91. An end portion of the second engagement/disengagement member 92 is formed in such a manner as to be gradually narrow in width toward the pressing direction. More specifically, the end portion is formed to have a tapered shape matching sloped faces of the interlocking member 93. The sloped face of the interlocking member 93 forms a slide face that is used to resiliently move the linear rack 91 to a sidewall opposing the pinion 90 of the bit reception plate 20 in association with the movement of the second engagement/disengagement member 92.

An end face opposite the slide face of the interlocking member 93 is engaged with linear guide grooves 91*a* formed along sidewalls on a side opposite rack-formed portions of the linear racks 91, thereby ensuring the movement positions of the linear racks 91. An engagement concave portion 91*b* is formed adjacent the rack-formed portion on the sidewall on the side of the rack-formed portion of the each linear rack 91. When being in a press limit position of the linear rack 91, the engagement concave portion 91*b* is resiliently engaged with the engagement protrusion 24*d*, which is formed on the supporting plate 24.

When releasing the pressure force of the second engagement/disengagement member 92, the engagement protrusion 24*d* urges the linear rack 91 in a direction of detachment from the pinion 90. As such, as shown in FIG. 15, the automatic rotation mechanism 70 has detent members for stopping backward rotation of the bit reception plates 20.

In the automatic rotation mechanism 70 for the bit reception plate 20 according to the modified example, in the first stage, the cam plate 19, which is fixedly mounted between the opposite faces of the individual supporting walls 13 of the base unit 11, detaches from the rack 91 in association with the descendent movement of the elevating unit 14 whereby to cancel the pressure force of the rack 91. However, the static state of the bit reception plate 20 is maintained inasmuch as the pressure force of the second engagement/disengagement member 92 is not canceled. While this state being maintained and elevating unit 14 is kept descended, in the second stage, the cam plate 19 is detached from the second engagement/disengagement member 92 whereby to cancel the pressure force of the second engagement/disengagement member 92.

Upon cancellation of the pressure force of the second engagement/disengagement member 92, the engagement protrusion 24*d* urges in a direction of detachment from the engagement concave portion 91*b* whereby to cancel the pressure force of the interlocking member 93. Then, the engagement between the rack 91 and the pinion 90 is released and the second engagement/disengagement member 92 returns to the position shown in FIG. 15. While this state being maintained, the locked state of the bit reception plate 20 is maintained.

When the elevating unit 14 is in a standby state at a descending-limit position, the cam plate 19 is in a detached position with respect to the rack 91 and the engagement/disengagement member 92. When the operating handle 15 is rotationally moved counterclockwise, the elevating unit 14 begins to ascend from the descending-limit position to an ascending-limit position. In the first stage, the cam surface of the cam plate 19 pushes the second engagement/disengagement member 92 in association with the ascending operation of the elevating unit 14. Thereby, the rack 91 and the pinion 90 are engaged with each other via the interlocking member 93.

In the second stage shown in FIG. 16, while this state is being maintained, when the elevating unit 14 continues to ascend, the cam surface of the cam plate 19 pushes the rack 91. Thereby, the rack 91 and the pinion 90 are engaged with each other, and the bit reception plate 20 is automatically rotated by one pitch at a predetermined rotation angle. Concurrently, the engagement concave portion 91*b* of the rack 91 is resiliently engaged with the engagement protrusion 24*d* of the supporting plate 24.

Similar to the automatic rotation mechanism 70 for the bit reception plate 20 according to the above-described embodiment, the modified example also has the construction that rotates the bit reception plate 20 by a predetermined angle in connective operation with the approaching/retracting operation of the bit reception plate 20 and the hole punch bits 30. Accordingly, the simply structured automatic rotation mechanism 70 can be intensively disposed in the same plane as the bit reception plate 20 and downsized. Components such as the pinion 90, the rack 91, the second engagement/disengagement member 92, and the interlocking member 93 may each be of a structure similar to a simple rectangular plate piece, and need not be formed into an intricate structure. Consequently, miniaturization, compaction, weight reduction, thickness reduction, and the like of the overall apparatus can be securely implemented.

Figure 17:
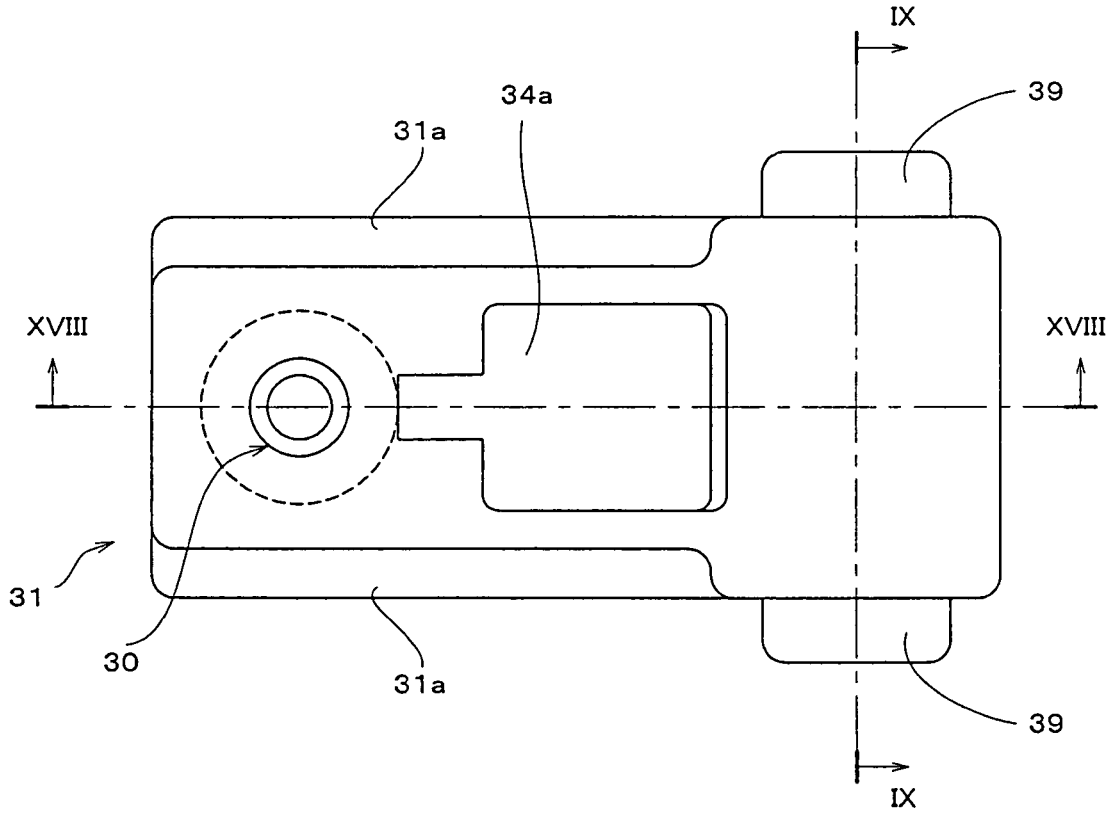
FIG. 17 is an upper-portion plan view showing a modified example of a hole-punch-bit support unit.
Figure 18:
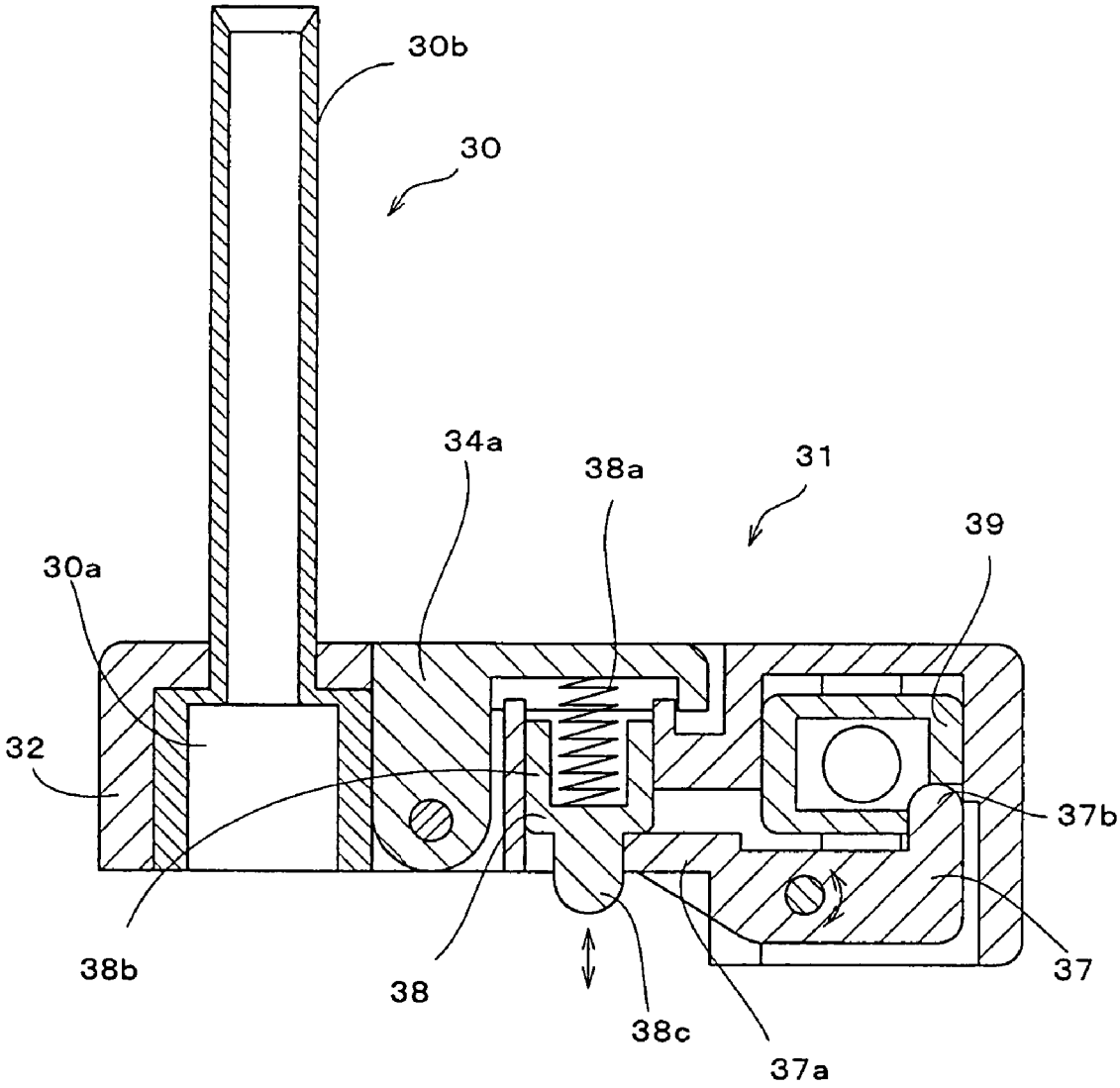
FIG. 18 is a cross-sectional view taken along the line XVIII-XVIII of FIG. 17.
Figure 19:
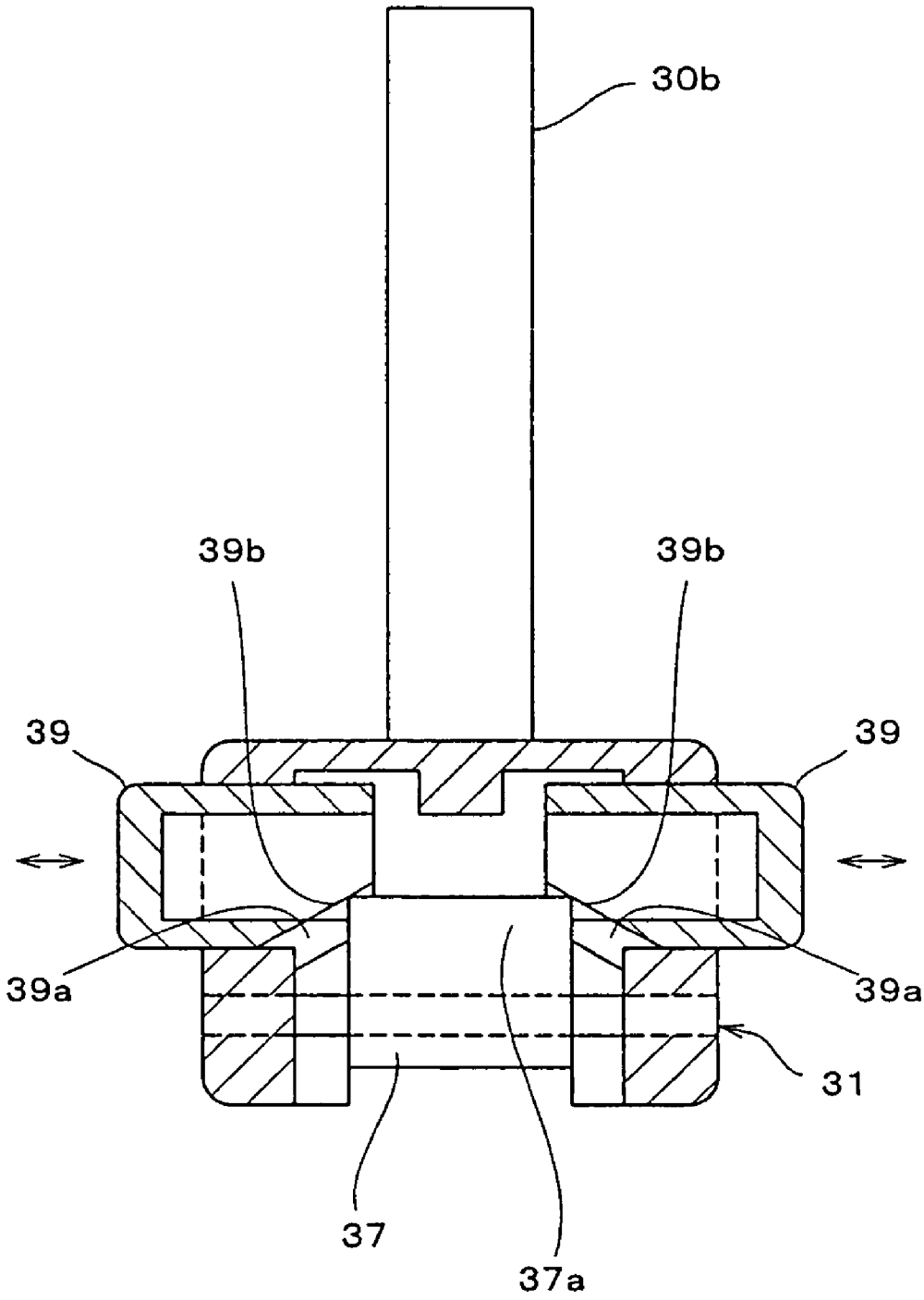
FIG. 19 is a cross-sectional view taken along the line IX-IX of FIG. 17.
Figure 20:
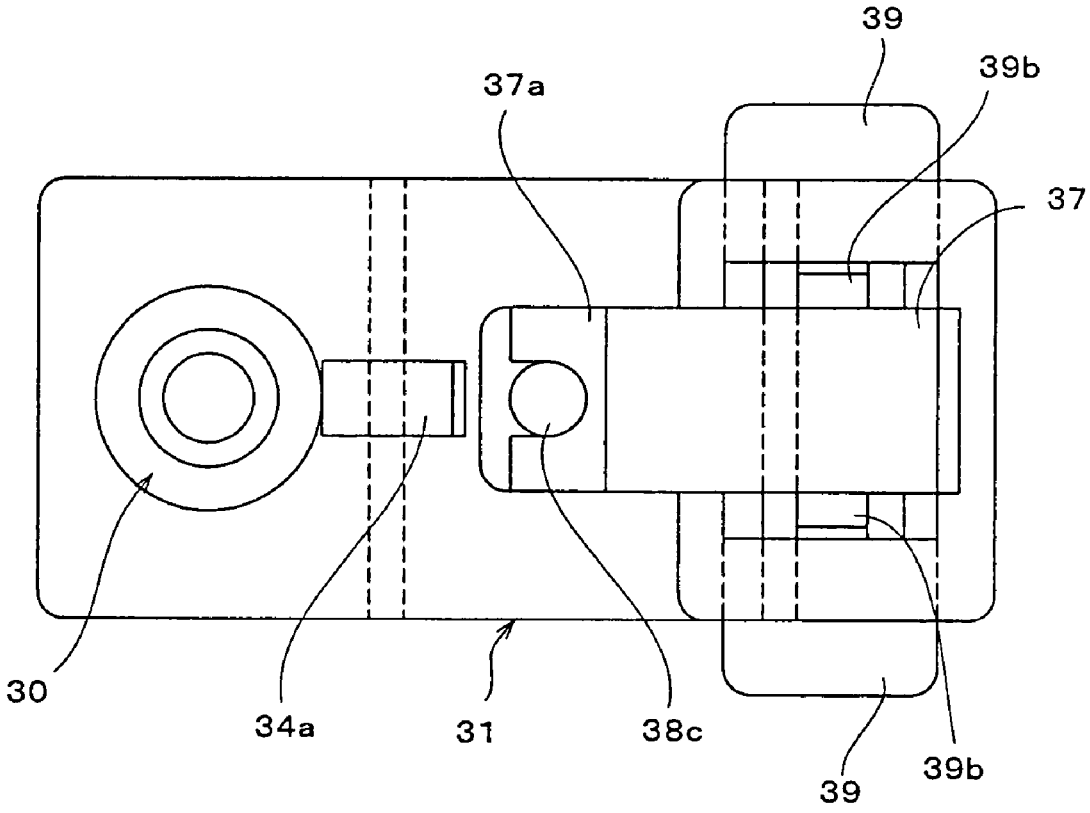
FIG. 20 is a lower-portion plan view of the hole-punch-bit support unit as viewed from a lower plane.

With reference to FIGS. 17 to 20, a modified example of a hole-punch-bit support unit suitably adaptable to the invention will be described below. FIG. 17 shows a schematic view of a contour pattern of the hole-punch-bit support unit as viewed from an upper plane; FIGS. 18 and 19 shows example interior structures of the the hole-punch-bit support unit; and FIG. 20 shows a schematic view of a contour pattern of the hole-punch-bit support unit as viewed from a lower plane. More specifically, FIG. 18 is a cross-sectional view taken along the line XVIII-XVIII of FIG. 17; and FIG. 19 is a cross-sectional view taken along the line IX-IX of FIG. 17. In the drawing figures, the same names and reference numerals are used for the substantially same members, and detailed descriptions thereof will be omitted herefrom.

Referring to theses drawing figures, a hole-punch-bit support unit 31 according to an illustrated example is different for the oscillatory movement member 35 shown in FIG. 6 in that the engagement with the base unit 11 is released in the manner that the oscillatory-movement supporting point side of the oscillatory movement member 37 undergoes vertical depression operation performed from the right and left sides. Similar to the hole-punch-bit support unit shown in FIG. 6, the hole-punch-bit support unit 31 according to the illustrated example is constructed to include a lengthy rectangular shell unit that has wall portions formed in front and rear and left and right portions of a flat lower surface and that has an opened bottom portion.

As shown in FIG. 17, flanges 31*a*, 31*a* for insertion/detachment with respect to the base unit 11 are formed in left and right wall portions. As shown in FIG. 18, inside the hole-punch-bit support unit 31, there is formed a circularly cylindrical hole-punch-bit support portion 32 that has an insertion opening for insertion-supporting the proximal end portion 30*a* of the hole punch bit 30 from a lower side. In addition, a rectangularly cylindrical insertion/detachment space portion 33 is formed in a position of the base unit 11 corresponding to the engagement hole portion 11*d* (shown in FIG. 6).

In lieu of the presser bar leaf spring 34 shown in FIG. 9, a fall-out prevention member 34*a* having a substantially L shaped cross section for preventing the hole punch bit 30 from being escaped is fixedly supported inside the hole-punch-bit support portion 32 so as to be rotatable around a horizontal axis line with an lower end of a vertical portion thereof as a rotation center. In this case, an oscillatory movement end horizontally extending in the oscillation direction perpendicular to the above-described vertical portion is exposed to the outside.

As shown in FIG. 18, the oscillatory movement member 37 constituting an insertion/detachment manipulation portion is fixed and supported in the rectangularly cylindrical insertion/detachment space portion 33 to be rotationally movable about a horizontal axis line with a central portion thereof in the rotation center. On the oscillatory movement end side of the oscillatory movement member 37, an engagement/disengagement member 38 serving as an engagement/disengagement portion is disposed, and a pair of left and right manipulation members 39 serving as an insertion/detachment manipulation portion are disposed on an oscillatory-movement supporting point side thereof.

As shown in FIG. 18, the engagement/disengagement member 38 is constructed to include a compression spring 38*a*, a large-diameter circularly cylindrical main body 38*b* including the compression spring 38*a*, and a small-diameter engagement protrusion 38*c*. The circularly cylindrical main body 38*b* is supported in resilient abutment between the oscillatory movement end of the fall-out prevention member 34*a* and the oscillatory movement end of the oscillatory movement member 37. The engagement/disengagement member 38 is all time supported resiliently downwardly by the insertion/detachment space portion 33. A vertical portion of the fall-out prevention member 34*a* is constantly held in resilient contact toward the proximal end portion 30*a* of the hole punch bits 30.

As shown in FIGS. 19 and 20, the manipulation members 39 are each disposed to be forwardly/backwardly movable with respect to left and right sidewall portions corresponding to the insertion/detachment space portion 33 of the hole-punch-bit support unit 31 via a compression spring (not shown). The individual left and right manipulation members 39 have the same structure. In the each manipulation member 39, there are individually protrusively formed a hook piece 39*a* and a protrusion piece 39*b* that is adjacently provided perpendicular to the hook piece 39*a* and that has on an undersurface a face upwardly sloped toward a top end. A top-end engagement face of the hook piece 39*a* is resiliently supported at all times on an inner surface of the sidewall portion of the hole-punch-bit support unit 31 in resistance with the spring force of the compression spring.

As shown in FIGS. 18 and 20, the oscillatory movement member 37 has the following components. They are a yoked-type insertion portion 37*a* that is positioned extending in the oscillation direction of the main body and resiliently engaged with the engagement protrusion 38*c* of the engagement/disengagement member 38; a rectangular-plate like manipulation piece 37*b* that is guided in abutment with the sloped face of the protrusion piece 39*b* in the manipulation member 39 on an upper end portion on the oscillatory-movement supporting point side of the main body.

Suppose that when withdrawing the hole-punch-bit support unit 31 from the base unit 11, the individual manipulation members 39 are synchronously pushed. In this case, the manipulation piece 37*b* is depressed along the sloped faces of the protrusion pieces 39*b* with the central portion of the oscillatory movement member 37 as an oscillatory-movement supporting point. Concurrently, the yoked-type insertion portion 37*a* of the oscillatory movement member 37 pushes up the engagement/disengagement member 38 in resistance with the spring force. This releases the engagement of the engagement protrusion 38*c* of the engagement/disengagement member 38 with respect to the base unit 11.

At this event, in resistance with the spring force, the oscillatory movement end is pushed up with the lower end of the vertical portion of the fall-out prevention member 34*a* as the rotation center. Concurrently, the vertical portion of the fall-out prevention member 34*a* is intensively brought into press contact with the proximal end portion 30*a* of the hole punch bit 30. Accordingly, when withdrawing the hole-punch-bit support unit 31 from the base unit 11, the hole punch bit 30 can be prevented from falling out.

Even in the present embodiment, the manipulation member 39 is provided to resiliently engageable with or disengageable from the engagement/disengagement member 38 via the oscillatory movement member 37 supported to be oscillatorily movable in a direction perpendicular to the insertion/retraction direction of the hole-punch-bit support unit 31. Accordingly, when the manipulation member 39 is pushed in the horizontal direction perpendicular to the withdrawal direction of the hole-punch-bit support unit 31, the engagement state between the base unit 11 and the engagement/disengagement member 38 can be automatically released, and replacement operation therefor can be quickly performed.

Figure 21:
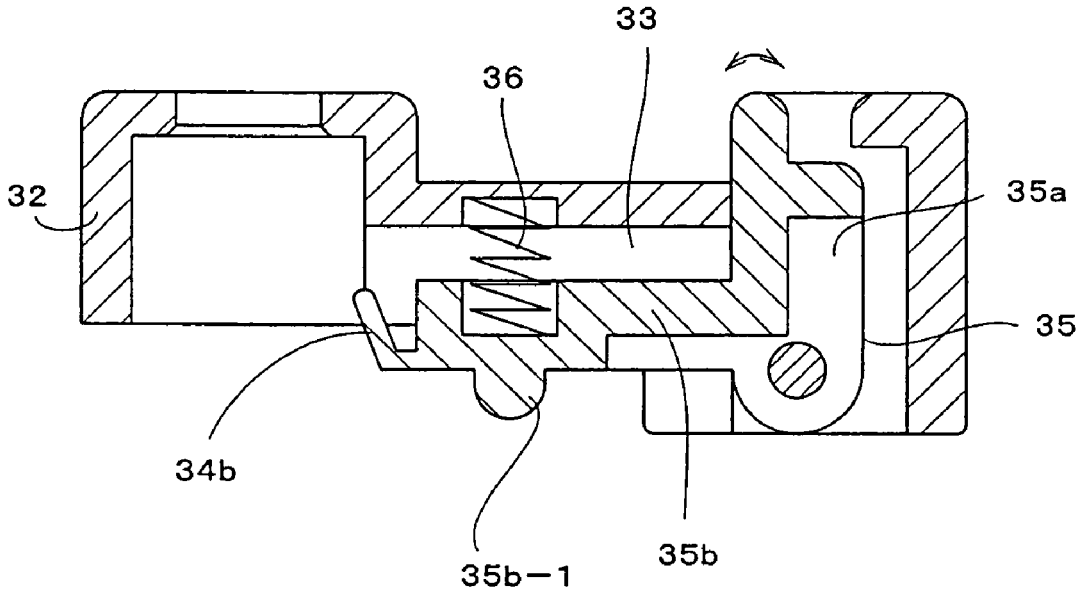
FIG. 21 is a major-portion vertical sectional view showing another modified example of a hole-punch-bit support unit.

FIG. 21 shows another modified example of a hole-punch-bit support unit suitably adaptable to the invention. More specifically, FIG. 21 is a view showing a vertical cutaway of major portions of the hole-punch-bit support unit. In the drawing figure, the same reference numerals represent the substantially same members as those in the above-described embodiment of the hole-punch-bit support unit.

A difference from the hole-punch-bit support unit 31 shown in FIG. 6 is that in lieu of the presser bar leaf spring 34 sown in FIG. 9 and the fall-out prevention member 34*a* shown in FIG. 18, a resilient contact piece 34*b* is provided upwardly extending from an oscillatory-movement edge face of the engagement/disengagement member 35*b* in the oscillatory movement member 35. A free end of the resilient contact piece 34*b* is supported in resilient abutment with the proximal end portion 30*a* of the hole punch bit 30.

In this manner, in the presence of the resilient contact piece 34*b*, number of assembly components can be decreased, the hole-punch-bit support unit 31 can be manufactured at reduced costs, and the overall structure of the hole-punch-bit support unit 31 can be compactly formed.

Figure 22:
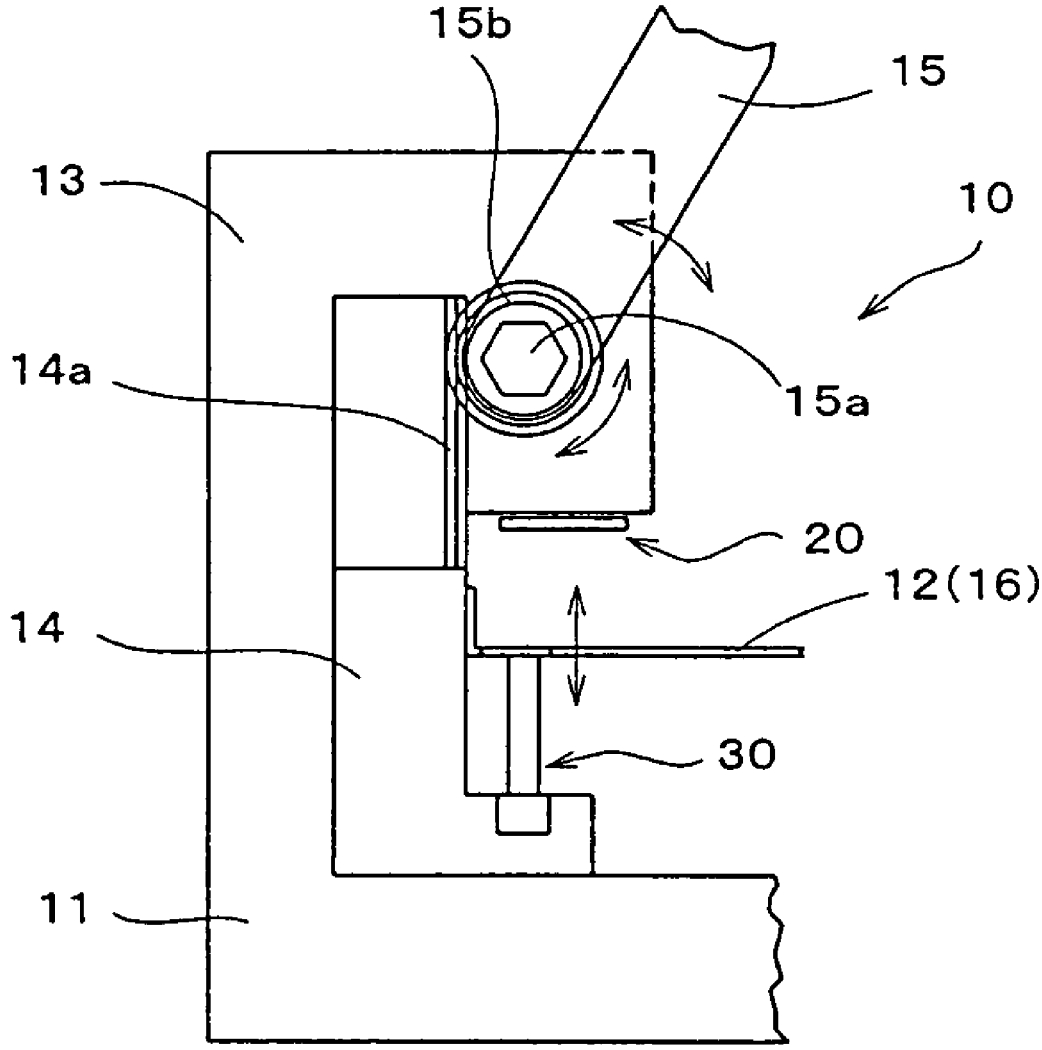
FIG. 22 is an explanatory view showing a modified example of the punch apparatus.

While the present embodiment has thus been described with reference to the punch apparatus 10 by way of example in which the elevating unit 14 is disposed to be approachable and retractable with respect to the base unit 11, the invention is not limited thereto. For example, the elevating unit 14 may be disposed to be approachable and retractable with respect to the supporting wall 13. By way of an example structure of this type, FIG. 22 shows a modified example of a paper punch apparatus. In the drawing figure, the same reference numerals are used to refer to the substantially members as those in the above-described embodiment, so that detailed descriptions thereof will be omitted herefrom.

In the example paper punch apparatus 10 shown in FIG. 22, the hole punch bit 30 is fixed and supported on the elevating unit 14 that performs approaching/retracting operation with respect to a base-unit opposite face of the supporting wall 13. On the base-unit opposite face, the bit reception plate 20 is disposed in opposition to an eccentric position with respect to the upper-end bit tip portion of the hole punch bit 30, and is supported rotatably about the vertical axis line. Even in the punch apparatus 10 according to the modified example, there may be disposed the bit-reception-plate insertion/removal mechanism, the hole-punch-bit attachment/removal mechanism, the bit-reception-plate automatic rotation mechanism, the scrap collection receptacle, and the paper abutment member.

In the above, the preferred embodiments of the invention have been described by way of examples. For example, the apparatus need not be provided with all the mechanisms, such as the bit-reception-plate insertion/removal mechanism, the hole-punch-bit attachment/removal mechanism, the bit-reception-plate automatic rotation mechanism, the scrap collection receptacle (structure and pattern), and the paper-abutment-member laying mechanism. Depending on relations with other conditional factors such as the mounting position of the elevating unit 14, and the relative movements of, for example, the bit reception plate 20 and the hole punch bit 30, the objects of the invention can of course be sufficiently achieved with any one of the bit-reception-plate insertion/removal mechanism, the hole-punch-bit attachment/removal mechanism, the bit-reception-plate automatic rotation mechanism, the scrap collection receptacle (structure and pattern), and the paper abutment member or with arbitrary combinations thereof. Accordingly, it is a matter of course that the invention is not limited to the above-described embodiments and modified examples, but various design modifications may be made within ranges of all features of the invention.

The paper punch apparatus of the invention is capable of perforating not only in general papers, but also other materials, such as films and thin planar sheets manufactured of, for example, synthetic resins.

What is claimed is:

1. A paper punch apparatus for forming a binding hole(s) into one or more paper sheets between a bit reception plate and a tubular hole punch bit, wherein the bit reception plate includes a supporting axis, a flange portion at one end thereof, and a discoidal main body at another end thereof, and a main body of the punch apparatus includes an insertion/removal portion for insertably supporting the supporting axis, a flange-storing space for storing the flange portion, a bit-reception-plate engagement/disengagement portion for engagement/disengagement with respect to the flange portion of the bit reception plate in the flange-storing space, an engagement/disengagement concave portion is formed in the flange portion, and the bit-reception-plate engagement/disengagement portion includes an engagement/disengagement protrusion for engagement/disengagement with respect to the engagement/disengagement concave portion, an engagement/disengagement member to be resiliently urged toward the engagement/disengagement concave portion, and an engagement/disengagement member operation portion for vertically moving the engagement/disengagement member, the engagement/disengagement member includes a large-diameter circularly cylindrical portion and a small-diameter rod portion that are colinearly disposed via a stepped face, the engagement/disengagement member operation portion resiliently supports an oscillatory movement piece, which oscillatorily moves with a central position as an oscillatory-movement supporting point, and one end of the oscillatory movement piece is fitted on the stepped face of the engagement/disengagement member and resiliently supported and another end of the oscillatory movement piece is abutting a manipulation knob which is fitted to the main body of the punch apparatus.

* * * * *